US007270409B2

(12) United States Patent
Iwasaki et al.

(10) Patent No.: US 7,270,409 B2
(45) Date of Patent: Sep. 18, 2007

(54) LIQUID APPLYING APPARATUS AND INK JET PRINTING APPARATUS

(75) Inventors: Osamu Iwasaki, Tokyo (JP); Naoji Otsuka, Yokohama (JP); Yoshinori Nakagawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 298 days.

(21) Appl. No.: 11/052,023

(22) Filed: Feb. 8, 2005

(65) Prior Publication Data

US 2005/0200666 A1 Sep. 15, 2005

(30) Foreign Application Priority Data

Feb. 12, 2004 (JP) ..... 2004-035805

(51) Int. Cl.
*B41J 2/01* (2006.01)
*B95C 11/02* (2006.01)

(52) U.S. Cl. ..... 347/103; 118/48

(58) Field of Classification Search ..... 347/101, 347/103, 102; 346/135.1; 118/46, 263, 118/602

See application file for complete search history.

(56) References Cited

U.S. PATENT DOCUMENTS 3,905,785 A 9/1975 Fabre ..... 55/96
4,284,343 A * 8/1981 Junghanns ..... 396/606
4,449,476 A * 5/1984 Voswinckel et al. ..... 118/674
4,949,667 A * 8/1990 Yoshida et al. ..... 118/60
5,045,888 A * 9/1991 Imaeda ..... 399/341
5,056,036 A * 10/1991 Van Bork ..... 700/282
5,132,706 A * 7/1992 Yuasa et al. ..... 346/140.1
5,207,159 A 5/1993 DeMoore et al. ..... 101/350
5,367,982 A 11/1994 DeMoore et al. ..... 118/46
5,960,713 A 10/1999 DeMoore et al. ..... 101/137
5,993,524 A * 11/1999 Nagai et al. ..... 106/31.27
6,183,079 B1 2/2001 Meade et al.
6,706,118 B2 * 3/2004 Heink et al. ..... 118/697
7,105,203 B1 9/2006 Masuda et al. ..... 427/286

FOREIGN PATENT DOCUMENTS

CN 1079689 A 12/1993

(Continued)

OTHER PUBLICATIONS

Chinese Office Action, issued on Dec. 22, 2006, in Chinese Application No. 200510008252.X and its English translation.

*Primary Examiner*—Anh T. N. Vo
(74) *Attorney, Agent, or Firm*—Fitzpatrick, Cella, Harper & Scinto

(57) ABSTRACT

A liquid applying apparatus and an ink jet printing apparatus can reduce evaporation that may occur when an application liquid is left in a liquid holding member for a long time. The liquid holding member forms a space between an elastic member and a roller to hold the application liquid. The apparatuses also are capable of preventing the leakage of the liquid from the liquid holding member regardless of a variation in the posture of the apparatus. In collecting the application liquid from the liquid holding member to a storage tank, the apparatuses switch a selector valve to allow an air communicating port and a tube to communicate with each other. The apparatuses further drive a pump to collect the application liquid from a liquid applying member and channel to the storage tank. Once the collecting is finished, the air communicating valve is closed.

15 Claims, 26 Drawing Sheets

FOREIGN PATENT DOCUMENTS

| | | |
|---|---|---|
| CN | 1263798 A | 8/2000 |
| JP | 8-58069 | 3/1996 |
| JP | 8-72227 | 3/1996 |
| JP | 2001-70858 | 3/2001 |
| JP | 2002-96452 | 4/2002 |
| JP | 2002-517341 | 6/2002 |

* cited by examiner

LIQUID APPLYING APPARATUS AND INK JET PRINTING APPARATUS

BACKGROUND OF THE INVENTION

1. Field of the Invention

The present invention relates to a liquid applying apparatus and an ink jet printing apparatus, and specifically, to a liquid applying apparatus that applies a liquid to a medium for a predetermined purpose, for example, for starting the coagulation of pigments earlier when printing is carried out using inks composed of the pigments as color materials. Likewise, the present invention relates to an ink jet printing apparatus comprising a mechanism that applies the liquid to a print medium used for ink jet printing, for a predetermined purpose, for example, for starting the coagulation of pigments earlier when printing is carried out using inks composed of the pigments as color materials.

2. Description of the Related Art

A spin coater, a roll coater, a bar coater, and a die coater are known as systems for applying a liquid or an aqueous material to various media. These applying systems are premised on continuous applying on relatively long applying media. Thus, for example, if liquid is applied to applying media having a relatively small size and being intermittently conveyed, paint beads may be disturbed at a position at which the applying is started or ended. In this case, the coats obtained may be nonuniform among the applying media.

A known configuration that can solve this problem is described in Japanese Patent Application Laid-open No. 2001-070858. On the basis of the die coater system, this configuration uses a rotating rod bar and ejects a paint to the rod bar through an ejection slit to form a coat on the rod bar. The coat formed is contacted with and transferred to an applying medium as the rod bar rotates. In this case, when the coat formed on the rod bar is not transferred or applied to the applying medium, the paint is returned to a head by the rotation of the rod bar. The paint is then collected via a collecting slit. In other words, the rod bar continues to rotate even during non-applying, while the paint is being formed into a coat on the rod bar. This enables a uniform coat to be obtained even if the applying media are intermittently supplied and applied with the paint.

Even in the field of ink jet printing apparatuses, those using a liquid applying mechanism are known. Japanese Patent Application Laid-open No. 2002-517341 describes an apparatus which uses a doctor blade contacting with a roller and in which the application liquid is collected between the blade and the roller so that the application liquid is applied to the roller as the roller rotates. As the roller rotates, the application liquid applied to the roller is transferred and applied to a support conveyed between this roller and another roller. Japanese Patent Application Laid-open No. 08-072227 (1996) similarly discloses a mechanism in an ink jet printing apparatus which applies a treatment liquid before printing which liquid insolubilizes dyes. In Embodiment 1 of this document, the treatment liquid in a replenishing tank is pumped by being attached to the rotating roller. At the same time, the treatment liquid pumped is applied to print paper.

With the configurations described in the above patent documents, an application liquid is applied or supplied to the surface of the rod bar or roller. However, the part of the rod bar or roller to which the application liquid is applied or supplied is open to or in communication with the air. Thus, disadvantageously, the application liquid may be evaporated or for example, the application liquid may leak when the posture of the apparatus is changed.

In particular, with an ink jet printing apparatus such as a printer, in view of, for example, the leakage of the liquid caused by a change in the posture of the apparatus, it is difficult to apply the applying mechanism described in the above documents to the apparatus if its size has been reduced.

In contrast, Japanese Patent Application Laid-open No. 08-058069 (1996) discloses a configuration that seals a part that applies or supplies inks, that is, application liquids, to a roller. The applying mechanism described in this document operates in a gravure printing apparatus to apply inks to a roller (applying roller) whose surface is formed with a pattern of a printing plate. This mechanism uses an ink chamber having two doctor blades arranged at two vertical positions along a peripheral surface of the roller and extending in a longitudinal direction of the roller and elastic members provided at the opposite sides of the two doctor blades. The chamber is contacted with the peripheral surface of the roller to form a liquid chamber between the ink chamber and the roller. Then, the roller is rotated to apply or supply the application liquid from the liquid chamber to the roller.

However, if the application liquid is left in the liquid chamber for a long time, then even with the appropriate sealing of the application liquid chamber, the evaporation of the application liquid from the liquid chamber may vary the concentration of the application liquid. This may result in unsatisfactory application.

Further, when the applying operation is not performed, if the applying roller remains in contact with or immersed in the applying liquid in the liquid chamber for a long time, then the applying liquid may degrade the applying roller.

Moreover, in spite of the appropriate sealing of the liquid chamber, the applying liquid may leak from the liquid chamber as a result of a change in the posture of the liquid applying apparatus such as a tilt. That is, if the liquid applying mechanism has a long structure, then in a normal applying posture, a longitudinal direction of the liquid applying mechanism corresponds to a horizontal direction. If the longitudinal direction of the liquid applying mechanism is changed so as to correspond to a vertical direction, a large difference occurs in water head between the upper side and lower side in the vertical direction, corresponding to the longitudinal direction. Pressure resulting from the difference in water head may cause the leakage of the liquid on the lower side in the vertical direction. Even if the longitudinal direction of the liquid applying mechanism is changed so as to correspond to a direction other than the vertical one, the leakage of the liquid may occur if a difference occurs in the water head between the upper side and lower side after the tilt. Therefore, the posture of the liquid applying apparatus during transportation or storage is limited. The liquid may leak from the liquid chamber unless the posture is carefully maintained.

SUMMARY OF THE INVENTION

The present invention is made to solve the above problems. It is an object of the present invention to provide a liquid applying apparatus and an ink jet printing apparatus which can reduce the evaporation of the application liquid when left in a liquid holding member for a long time, the liquid holding member holding the application liquid in a space between rollers, the liquid applying apparatus and ink jet printing apparatus being capable of preventing the leakage of the liquid from the liquid holding member.

In the first aspect of the present invention, there is provided a liquid applying apparatus comprising:

a liquid applying means, which is provided with an applying member that applies a liquid to a medium and a holding member that abuts against the applying member to form a liquid holding space to hold the liquid, for applying the liquid held in the liquid holding space to the medium through the applying member by rotating the applying member;

a storage means for storing the liquid;

a first path that allows the storage means and the holding member to communicate with each other;

a second path that allows the storage means and the holding member to communicate with each other; and a collecting means for allowing the first or second path to communicate with the air to generate a flow of the liquid in a channel including the first path, the liquid holding space and the second path so that the flow collects the liquid from the channel to the storage means.

In the second aspect of the present invention, there is provided a liquid applying apparatus comprising:

a liquid applying means, which is provided with an applying member that applies a liquid to a medium and a holding member that abuts against the applying member to form a liquid holding space to hold the liquid, for applying the liquid held in the liquid holding space to the medium through the applying member by rotating the applying member;

a storage means for storing the liquid;

a first path that allows the storage means and the holding member to communicate with each other;

a second path that allows the storage means and the holding member to communicate with each other;

switching means for switching whether the storage means and the holding member are communicate with each other or the air and the holding member are communicated with each other for the first path; and a liquid moving means for generating a flow of the liquid in a liquid path including the first path, the liquid holding space, and the second path, and wherein the switching means is placed in the first path, and the liquid moving means is placed downstream of the switching means in the first or second path. In the third aspect of the present invention, there is provided a liquid applying apparatus comprising:

a liquid applying means, which is provided with an applying member that applies a liquid to a medium and a holding member that abuts against the applying member to form a liquid holding space to hold the liquid, for applying the liquid held in the liquid holding space to the medium through the applying member by rotating the applying member;

a storage means for storing the liquid;

first and second paths that allow the storage means and the holding member to communicate with each other;

switching means for switching whether the storage means and the holding member communicate with each other or the air and the holding member are communicated with each other for the first path;

a liquid moving means for generating a flow of the liquid in a liquid path including the first path, the liquid holding space, and the second path, and collecting means for collecting the liquid from the channel to the storage means by using the switching means to allow the air and the holding member to communicate with each other and using the liquid moving means to generate a flow of the liquid, and wherein the switching means is placed upstream in a direction of a flow of the liquid which occurs when the collecting means collects the liquid, compared to the holding member, and the liquid moving means is placed downstream in the direction of the flow of the liquid which occurs when the collecting means collects the liquid, compared to the switching means. In the fourth aspect of the present invention, there is provided a liquid applying apparatus comprising:

a liquid applying means, which is provided with an applying member that applies a liquid to a medium and a holding member that abuts against the applying member to form a liquid holding space to hold the liquid, for applying the liquid held in the liquid holding space to the medium through the applying member by rotating the applying member;

a storage means for storing the liquid;

a first path which allows the storage means and the holding means to communicate with each other and which is at least partly placed so that a water head in the first path is higher than a highest storage level that is a level observed when the largest amount of liquid is stored in the storage means;

a second path that allows the storage means and the holding member to communicate with each other;

switching means for switching whether a part of the first path which is at a position of the water head higher than the highest storage level is to communicate with the air or to be shut off from the air;

liquid moving means for generating a flow of the liquid in a liquid path including the first path, the liquid holding space, and the second path; and collecting means for collecting the liquid from the channel to the storage means by using the switching means to allow the air and the holding member to communicate with each other and using the liquid moving means to generate a flow of the liquid, and wherein the switching means is placed upstream in a direction of a flow of the liquid which occurs when the collecting means collects the liquid, compared to the holding member, and the liquid moving means is placed downstream in the direction of the flow of the liquid which occurs when the collecting means collects the liquid, compared to the switching means. In the fifth aspect of the present invention, there is provided an ink jet printing apparatus comprising:

a liquid applying means, which is provided with an applying member that applies a liquid to a medium and a holding member that abuts against the applying member to form a liquid holding space to hold the liquid, for applying liquid held in the liquid holding space to the medium through the applying member by rotating the applying member;

an image forming means for forming an image by ejecting inks from a print head in which a plurality of nozzles are arranged on the medium to which the liquid has been applied by the liquid applying means;

a storage means for storing the liquid;

a first path that allows the storage means and the holding member to communicate with each other;

a second path that allows the storage means and the holding member to communicate with each other; and a collecting means for allowing the first or second path to communicate with the air to generate a flow of the liquid in a channel including the first path, the liquid holding space and the second path so that the flow collects the liquid from the channel to the storage means.

In the sixth aspect of the present invention, there is provided a printing apparatus comprising:

a liquid applying means, which is provided with an applying member that applies a liquid to a medium and a holding member that abuts against the applying member to form a liquid holding space to hold the liquid, for applying the liquid held in the liquid holding space to the medium through the applying member by rotating the applying member;

an image forming means for forming an image on the medium to which the liquid has been applied by the liquid applying means;

a storage means for storing the liquid;

a first path that allows the storage means and the holding member to communicate with each other;

a second path that allows the storage means and the holding member to communicate with each other; and a collecting means for allowing the first or second path to communicate with the air to generate a flow of the liquid in a channel including the first path, the liquid holding space and the second path so that the flow collects the liquid from the channel to the storage means.

In the seventh aspect of the present invention, there is provided a method for controlling of a liquid applying apparatus comprising:

a step of preparing the liquid applying apparatus comprising an applying member that applies a liquid to a medium and a holding member that abuts against the applying member to form a liquid holding space to hold the liquid, the apparatus applying the liquid held in the liquid holding space to the medium through the applying member by rotating the applying member, a step of allowing a first or second path to communicate with the air, the first or second path allowing a storage means for storing the liquid and the holding means to communicate with each other, and generating a flow of the liquid in a channel including the first path, the liquid holding space and the second path so that the flow collects the liquid from the channel to the storage means.

The "liquid moving means" according to the present invention may be a pump.

According to an embodiment of the present invention, the switching means carries out switching to allow the air and the holding member to communicate with each other so that the pump can be used to allow the liquid to flow from the supply path to the collection path or vice versa. Accordingly, the liquid from the holding member can be collected in the storage means. This makes it possible to reduce the evaporation of the liquid when left in the holding member for a long time.

Further, when the collection is finished, the storage means is shut off from the air to inhibit the liquid from flowing out of the storage means to the holding means. If the posture of the liquid applying apparatus is changed, the leakage of the liquid from the holding member can be prevented.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Preferred embodiments of the present invention will be described below in detail with reference to the accompanying drawings.

First Embodiment

According to the present embodiment, if the applying operation is not performed, a liquid is collected from a liquid holding space formed between an applying roller and a liquid holding member to hold the liquid.

Figure 1:
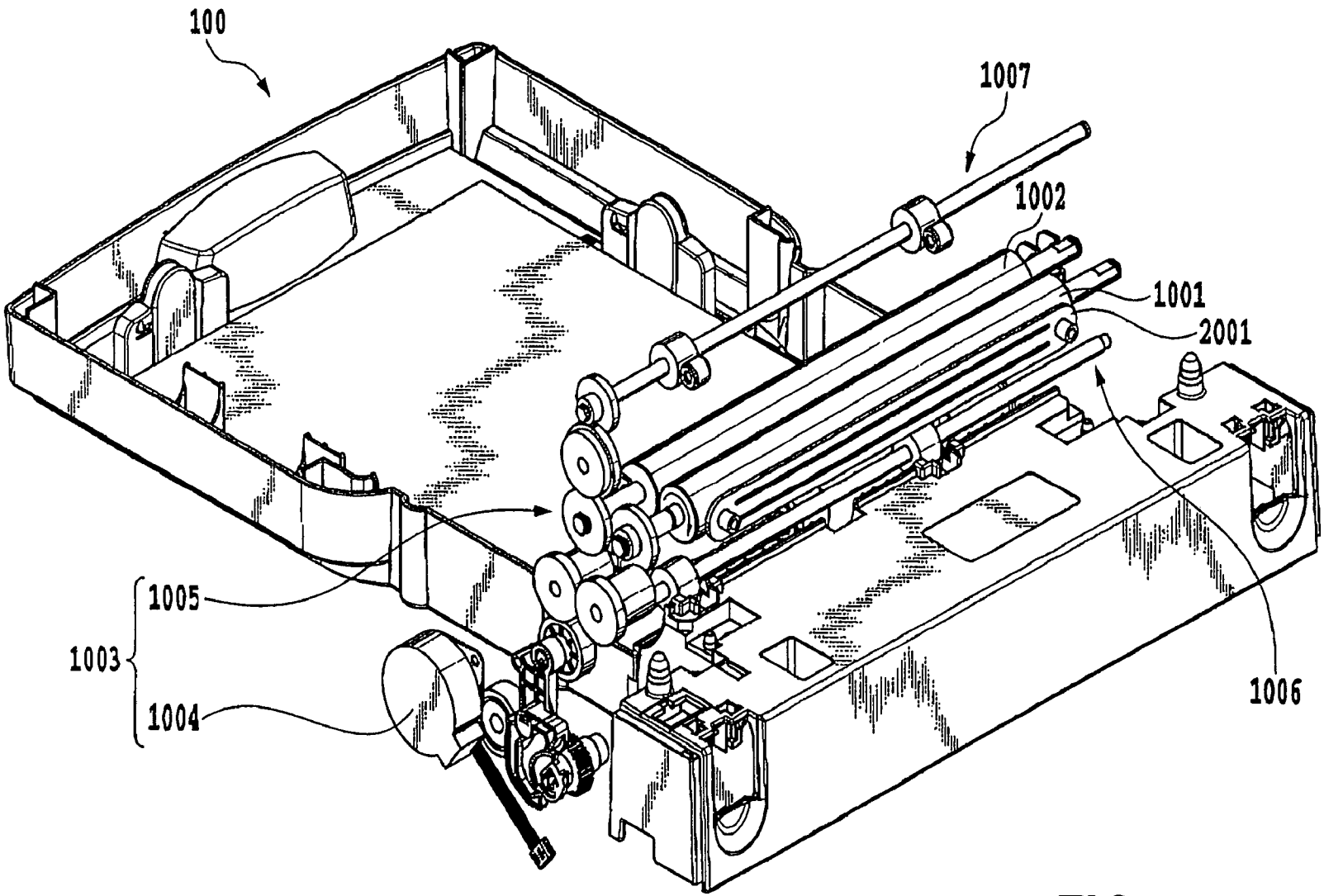
FIG. 1 is a perspective view generally showing the configuration of an embodiment according to a liquid applying apparatus of the present invention.

FIG. 1 is a perspective view generally showing the configuration of an embodiment according to a liquid applying apparatus 100 of the present invention. The liquid applying apparatus shown in FIG. 1 roughly has liquid applying means for applying a predetermined application liquid to a medium to which a liquid is to be applied (this medium will be referred to as an applying medium in the description below) and liquid supplying means for supplying an application liquid to the liquid applying means.

The liquid applying means has a cylindrical applying roller 1001, a cylindrical counter roller 1002 (medium supporting member) placed opposite the applying roller 1001, and a roller driving mechanism 1003 that drives the applying roller 1001. The roller driving mechanism 1003 comprises a roller driving motor 1004 and a transmission mechanism 1005 which transmits the driving force of the roller driving motor 1004 to the applying roller 1001 and which has a gear train and the like.

The liquid supplying means has, for example, a liquid holding member 2001 that holds the application liquid between the liquid holding member 2001 and a peripheral surface of the applying roller 1001, and a liquid channel 3000 (not shown in FIG. 1) described later and through which the liquid is supplied to the liquid holding member 2001. The applying roller 1001 and the counter roller 1002 are rotatively movably supported by respective shafts which are parallel to each other and each of which has opposite ends rotatively movably attached to a frame (not shown). Further, the liquid holding member 2001 extends almost all along the applying roller 1001 in a longitudinal direction. The liquid holding member 2001 is movably attached to the frame via a mechanism that enables the liquid holding member 2001 to contact with and separate from the peripheral surface of the applying roller 1001.

The liquid applying apparatus according to the present embodiment further comprises an applying medium supplying mechanism 1006 which consists of a pickup roller or the like to convey a applying medium to a nip portion between the applying roller 1001 and the counter roller 1002. Further, in a conveying path for applying media, a sheet discharging mechanism 1007 consisting of a sheet discharging roller or the like is provided downstream of the applying roller 1001 and the counter roller 1002 to convey an applying medium on which the application liquid has been applied, to a sheet discharging section (not shown). Like the applying roller and the like, the sheet supplying mechanism and the sheet discharging mechanism are operated under the driving force of the driving motor 1004 transmitted via the transmission mechanism 1005.

The application liquid used in the present embodiment is intended to facilitate the coagulation of pigments when printing has been carried out using inks including the pigments as color materials.

An example of the components of the application liquid is shown below.

Tetrahydrate of calcium nitrate: 10%

Glycerin: 42%

Surface active agent: 1%

Water: remaining amount

The application liquid has a viscosity of 5 to 6 cp (centipoise) at 25° C.

In applications of the present invention, of course, the application liquid is not limited to the one described above. For example, a liquid including a component which insolubilizes or coagulates a dye may be used as another application liquid.

If water is used as a liquid to be applied, the slidability of the abutting portion between the applying roller and the liquid holding member according to the present invention is improved by containing a component that reduces surface tension in the liquid. In the above example of the components of the liquid to be applied, the glycerin and the surface active agent are components that reduce the surface tension.

Figure 2:
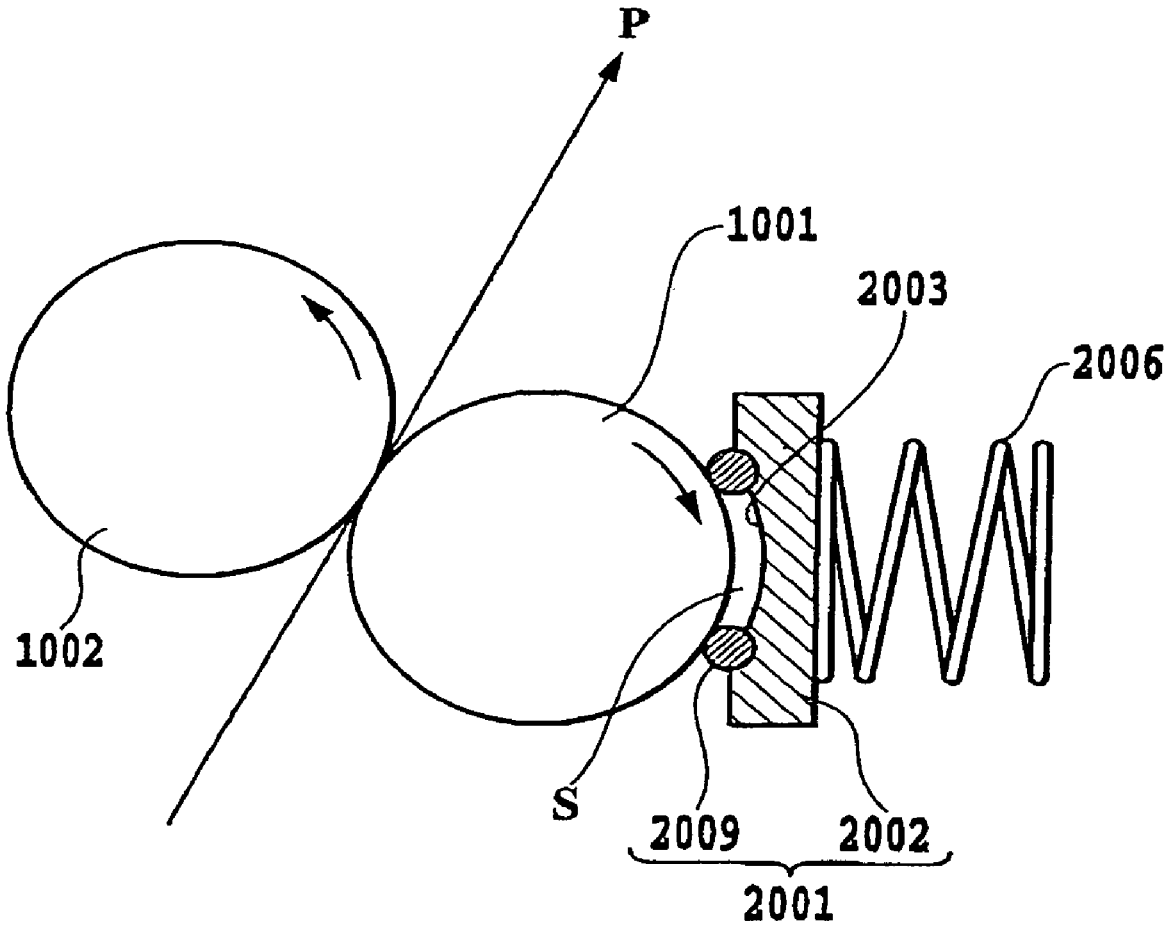
FIG. 2 is a vertical side view showing an example of the arrangement of a applying roller, a counter roller, and a liquid holding member which are shown in FIG. 1.

Now, a detailed description will be given of the elements of the sections of the applying apparatus described above in brief FIG. 2 is a vertical sectional view illustrating an example of the arrangement of the applying roller 1001, the counter roller 1002, and the liquid holding member 2001.

The counter roller 1002 is biased by biasing means (not shown) toward the peripheral surface of the applying roller 1001. By rotating the applying roller 1001 clockwise in the figure, it is possible to sandwich an applying medium P on which the application liquid is to be applied, between the rollers, while conveying the applying medium P in the direction of an arrow in the figure.

Further, when urged and abutted against the peripheral surface of the applying roller 1001 under the biasing force of a spring member (pressing means) 2006, the liquid holding member 2001 forms an elongate liquid holding space S extending all over an area applied the liquid by the applying roller 1001. The application liquid from a liquid channel 3000, described later, is supplied to the interior of the liquid holding space S via the liquid holding member 2001. In this case, since the liquid holding member 2001 is configured as described below, the application liquid can be prevented from inadvertently leaking from the liquid holding space S to the exterior while the applying roller 1001 is stopped.

FIGS. 3 to 8 show the configuration of the liquid holding member 2001.

Figure 3:
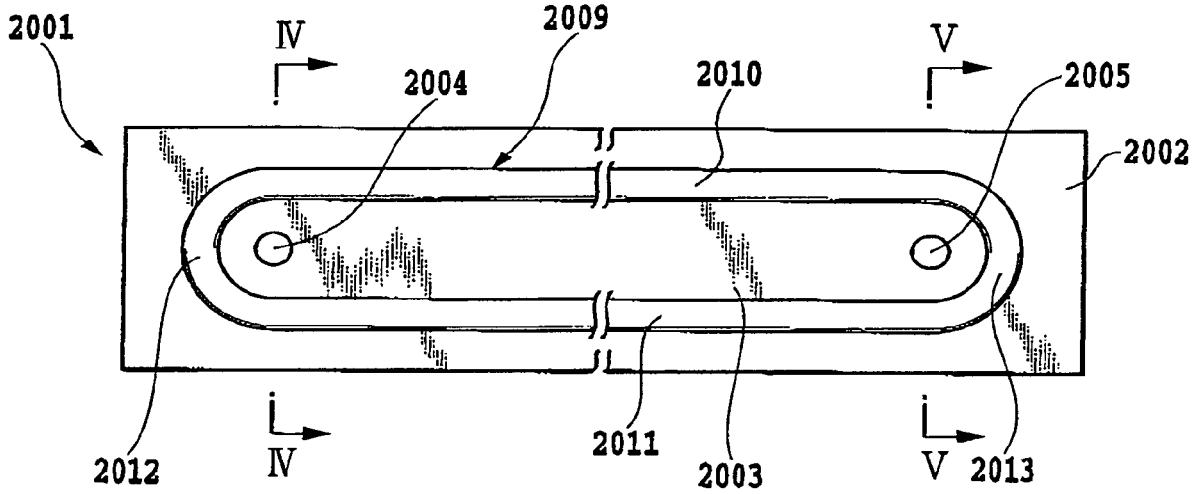
FIG. 3 is a front view of the liquid holding member shown in FIGS. 1 and 2.

As shown in FIG. 3, the liquid holding member 2001 has a space forming base material 2002 and an annular abutting member 2009 located on one surface of the space forming base material 2002. A concave portion 2003 is formed in a central portion of the space forming base material 2002 along its longitudinal direction; a bottom portion of the concave portion 2003 has a circular cross section. The abutting member 2009 has linear portions fastened along the upper edges of the concave portion 2003 and circumferential portions fastened so as to extend from the upper edge through the bottom portion to the opposite upper edge. Thus, when the abutting member 2009 of the liquid holding member 2001 abuts against the applying roller 1001, the abutment conforms to the shape of the peripheral surface of the applying roller. It is thus possible to achieve the abutment at a uniform pressure.

As described above, in the liquid holding member according to this embodiment, the abutting member 2009, formed integrally and seamlessly, is continuously abutted without a gap against the outer peripheral surface of the applying roller 1001 under the biasing force of the spring member 2006. As a result, the liquid holding space S is substantially closed by the abutting member 2009, one surface of the space forming base material, and the outer peripheral surface of the applying roller 1001. The liquid is held in this space. Then, when the rotation of the applying roller 1001 is stopped, the abutting member 2009 and the outer peripheral surface of the applying roller 1001 maintain a liquid tight state. The liquid can be reliably prevented from leaking to the exterior. On the other hand, when the applying roller 1001 is rotated, the application liquid can slipperily flow between the outer peripheral surface of the applying roller 1001 and the abutting member 2009 as described later. In this case, when the applying roller 1001 is stopped and the liquid tight state is established between the outer peripheral surface of the applying roller 1001 and the abutting member 2009, the liquid cannot flow out of the space as described above. In this case, the abutting state of the abutting member 2009 includes not only direct abutment against the outer peripheral surface of the applying roller 1001 but also abutment against the outer peripheral surface via a liquid film formed under a capillary force.

Figure 4:
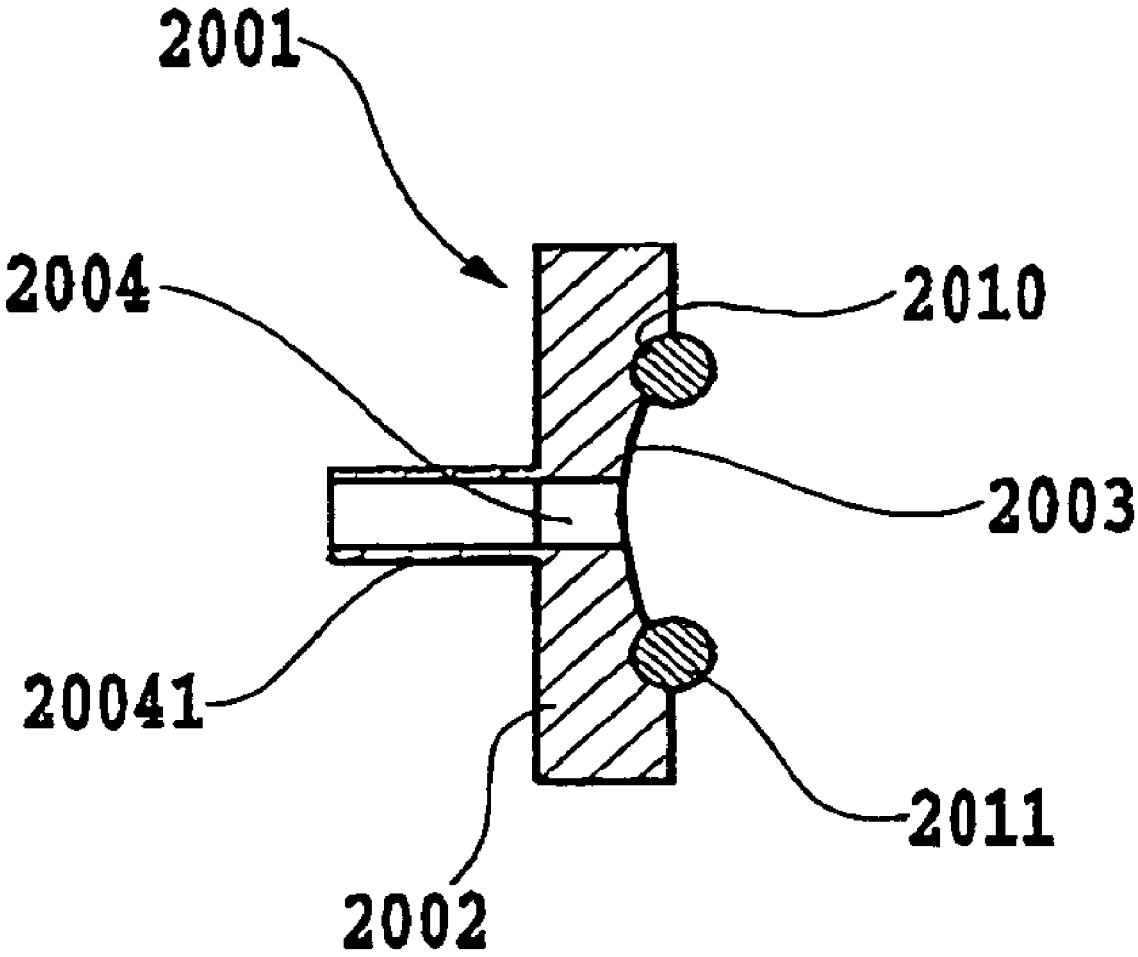
FIG. 4 is an end view showing an end surface of the liquid holding member shown in FIG. 3, the view taken along line IV-IV in FIG. 3.
Figure 5:
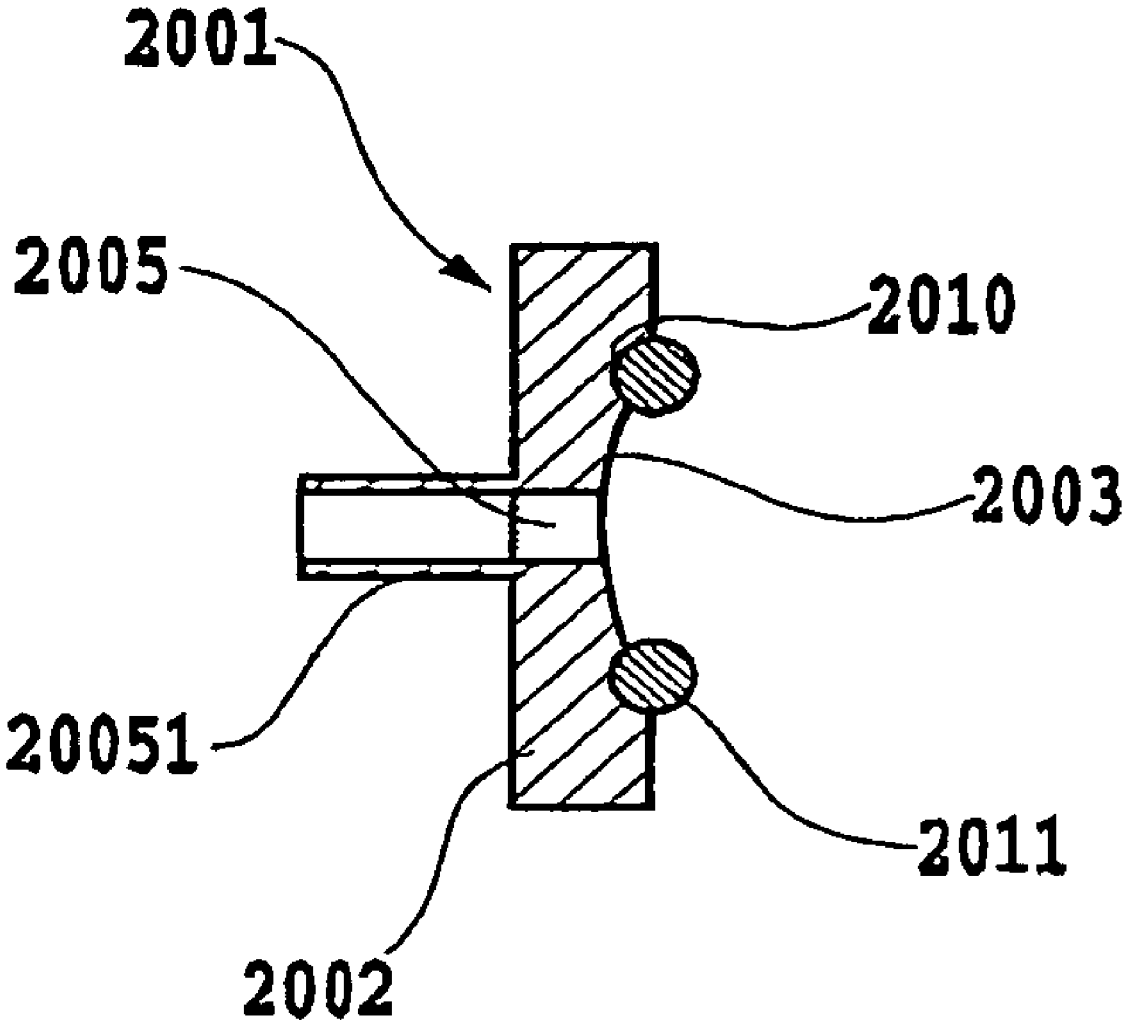
FIG. 5 is an end view showing the end surface of the liquid holding member shown in FIG. 3, the view taken along line V-V in FIG. 3.
Figure 6:
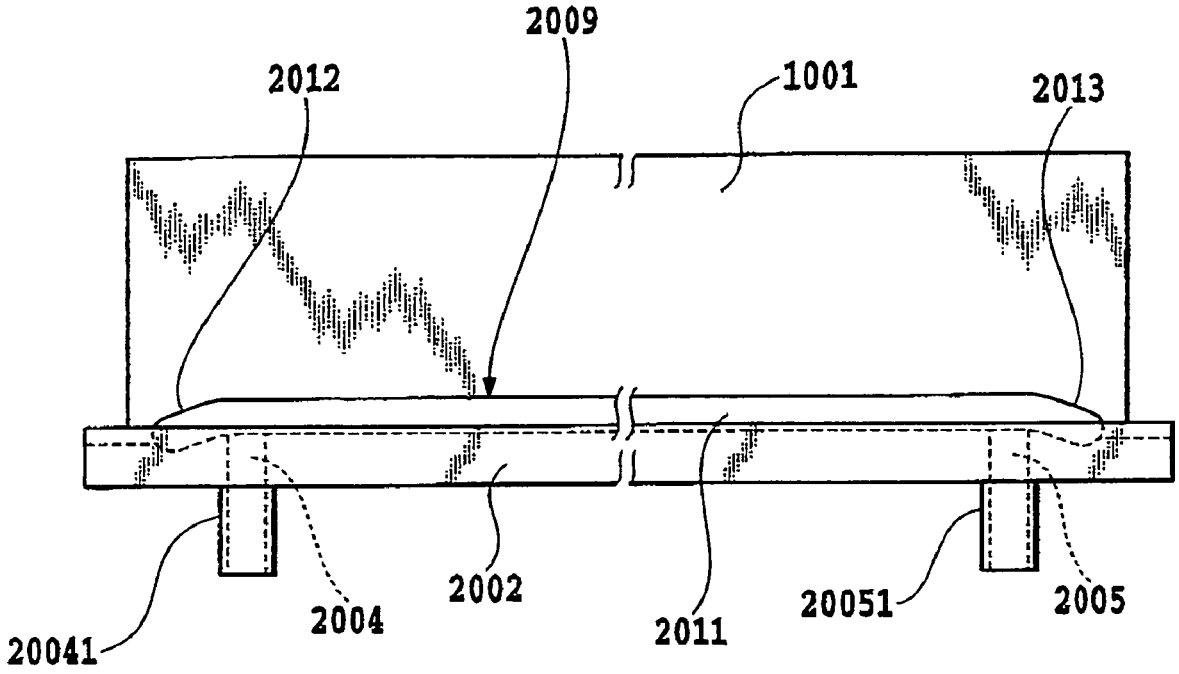
FIG. 6 is a plan view of the liquid holding member shown in FIG. 3.
Figure 7:
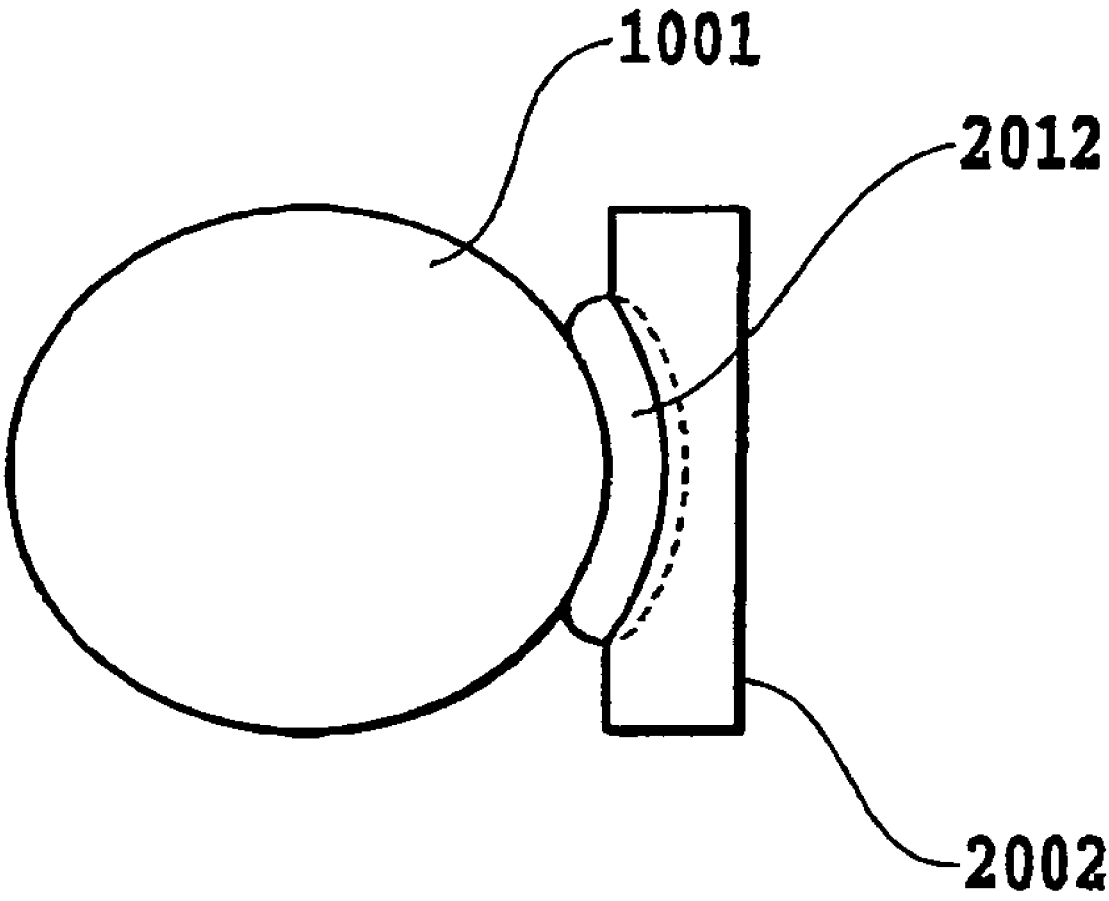
FIG. 7 is a left side view showing how an abutting portion of the liquid holding member shown in FIG. 3 is abutted against a liquid applying roller.
Figure 8:
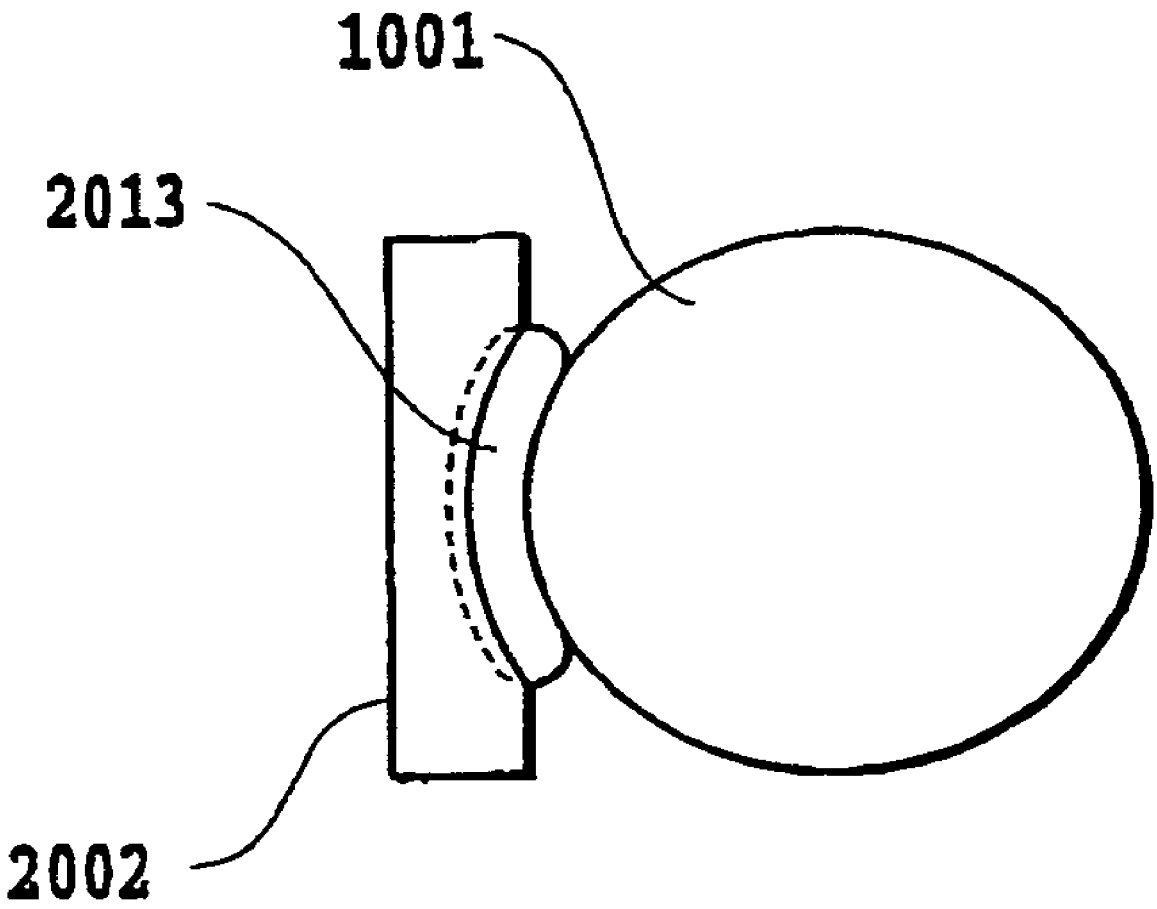
FIG. 8 is a right side view showing how the abutting portion of the liquid holding member shown in FIG. 3 is abutted against the liquid applying roller.

As shown in FIGS. 3 to 8, the longitudinally opposite sides of the abutting member 2009 are gently curved as viewed from its front (FIG. 3), from above (FIG. 6), or from its side (FIGS. 7 and 8). Thus, even when the abutting member 2009 is abutted against the applying roller 1001 under a relatively high pressure, the whole abutting member 2009 is substantially uniformly elastically deformed. This prevents large distortions locally. Thus, as shown in FIGS. 6 to 8, the abutting member 2009 abuts tightly without the gap against the outer peripheral surface of the applying roller 1001. As a result, a substantially closed space can be formed as described above.

On the other hand, as shown in FIGS. 3 to 5, a liquid supplying port 2004 and a liquid collecting port 2005 are formed in an area of the space forming base material 2002 which is surrounded by the abutting member 2009; the liquid supplying port 2004 and the liquid collecting port 2005 have holes penetrating the space forming base material 2002. The liquid supplying port 2004 and the liquid collecting port 2005 are communicating with cylindrical connecting portions 20041 and 20051 projected from a back surface of the space forming base material. Further, the connecting portions 20041 and 20051 are connected to a liquid channel 3000 described later. In this embodiment, the liquid supplying port 2004 is formed near one end of an area surrounded by the abutting member 2009 (the left end in FIG. 3), while the liquid collecting port 2005 is formed near the other end of the same area (the right end in FIG. 3). The liquid supplying port 2004 is used to supply the application liquid provided through the liquid channel 3000, to the liquid holding space S. The liquid collecting port 2005 is used to allow the liquid in the liquid holding space S to flow out to the liquid channel 3000. The supply and flowout of the application liquid allows the liquid to flow from the left end to right end of the liquid holding space S.

(Application Liquid Channel)

Figure 11:
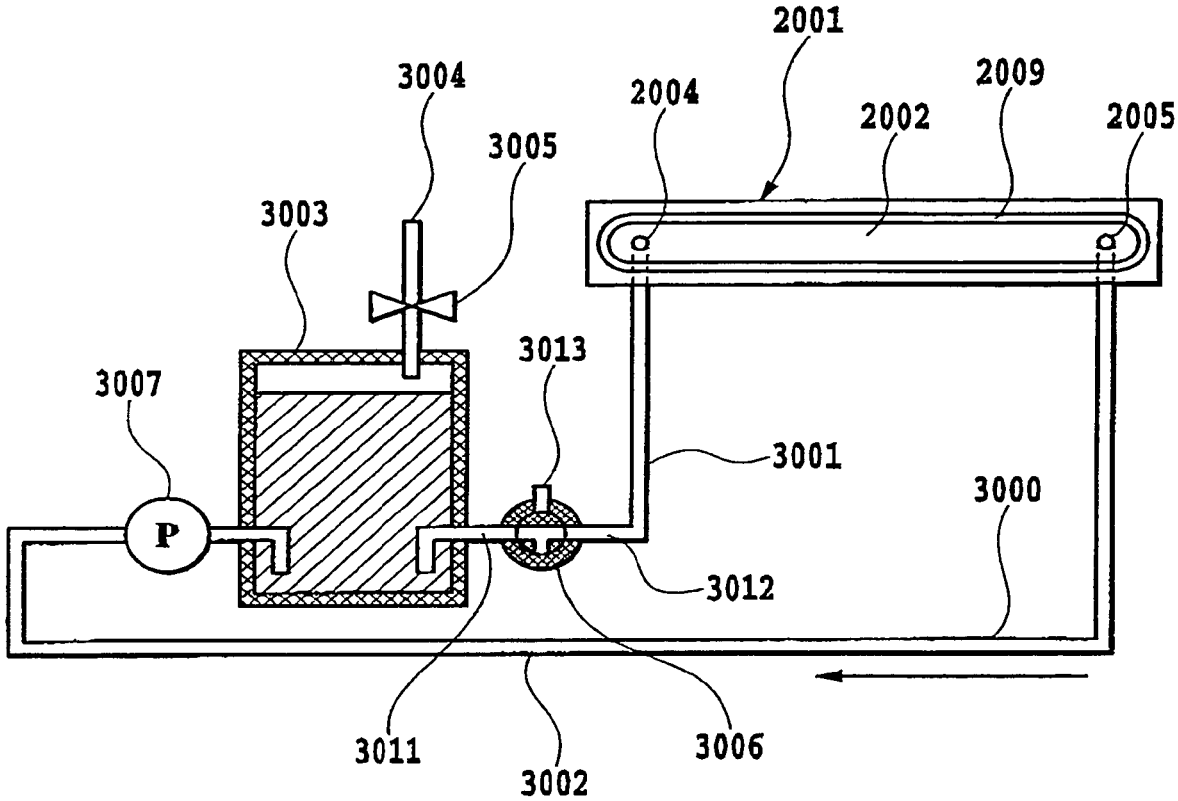
FIG. 11 is a diagram generally showing the configuration of a liquid channel in the liquid applying apparatus according to the embodiment of the present invention.

FIG. 11 is a diagram generally illustrating the configuration of the liquid channel 3000, connected to the liquid holding member 2001 of the application liquid supplying means.

The liquid channel 3000 has a first channel 3001 that connects the liquid supplying port 2004 of the space forming base member 2002, constituting the liquid holding member 2001, to a storage tank 3003 that stores the application liquid, a second channel 3002 that connects the liquid collecting port 2005 of the space forming base material 2002 to the storage tank 3003 together. An air communicating port 3004 is formed in the storage tank 3003. The air communicating port is provided with an air communicating valve 305 that selectively enables and disables the communication between the port and the air. The air communicating port 3004 desirably has a labyrinthine structure in order to inhibit evaporation. Further, the first channel 3001 is provided with a selector valve 3006. The selector valve 3006 selectively enables and disables the communication between the first channel 3001 and the air. Moreover, the second channel 3002 connects to a pump 3007 used to force the application liquid and air to flow through the liquid channel 3000 in a desired direction. In this case, a flow of a liquid is generated which is directed from the first channel 3001 to the second channel 3002 via the liquid holding space S.

In this embodiment, the first channel 3001 and the second channel 3002 are formed of cylindrical tubes. An opening formed at an end of each tube is placed at the bottom of the storage tank 3003 or close to the bottom. The position of the opening allows the application liquid in the storage tank 3003 to be completely consumed.

Figure 18:
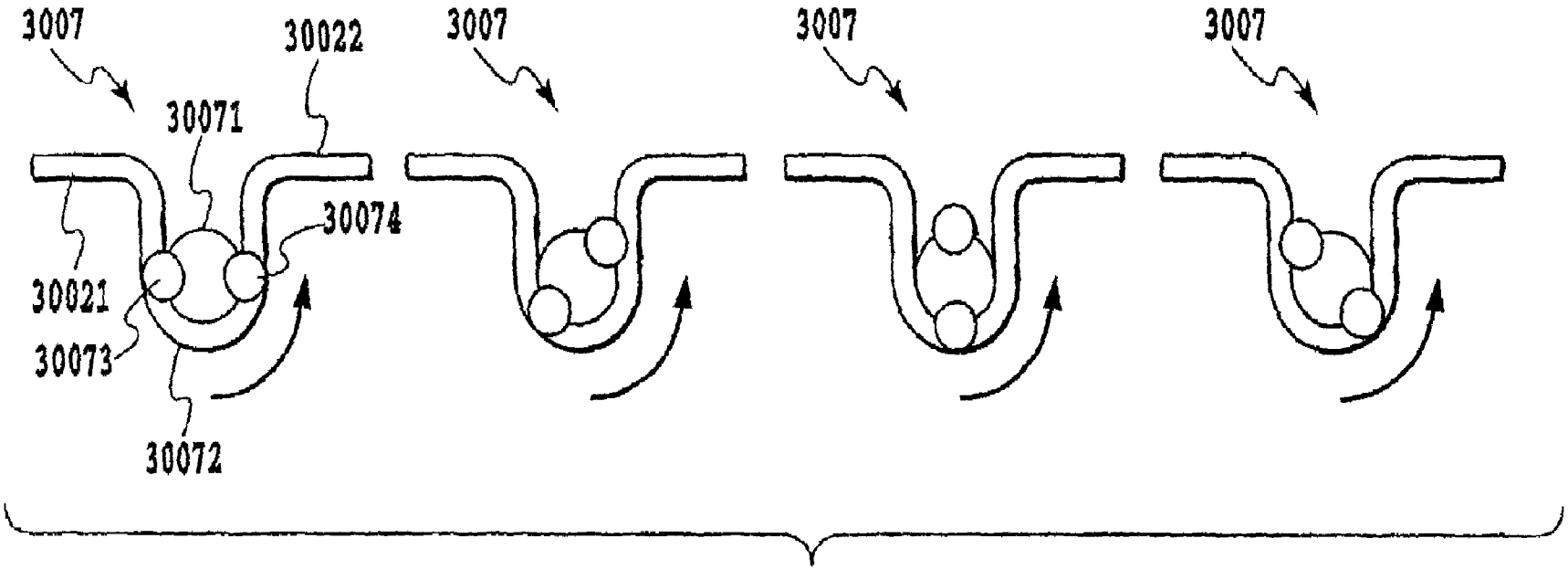
FIG. 18 is a diagram illustrating operations of a pump according to the embodiment of the present invention.

The pump 3007 according to this embodiment is composed of a tube pump shown in FIG. 18. The tube pump 3007 has a rotor 30071 rotated by a pump driving motor (not shown), a flexible pump constituting tube 30072 circularly disposed along the outside of the rotor 30071, and two rollers 30073 and 30074 rotatively movably supported by the rotor 30071. With this tube pump, the rotor 30071 rotates to allow at least one of the rollers 30073 and 30074 to roll while squeezing the pump constituting tube 30072. This rolling drives the application liquid or air in the pump constituting tube 30072 downstream (in FIG. 18, to the storage tank tube 30022), while sucking the application liquid or air from a liquid holding member tube 30021. Further, while the driving of the tube pump 3007 is at a stop, the tube pump 3007 remains inactive while squeezing the pump constituting tube. Consequently, the communication between the tube 30021 and the tube 30022 is shut off.

Figure 19:
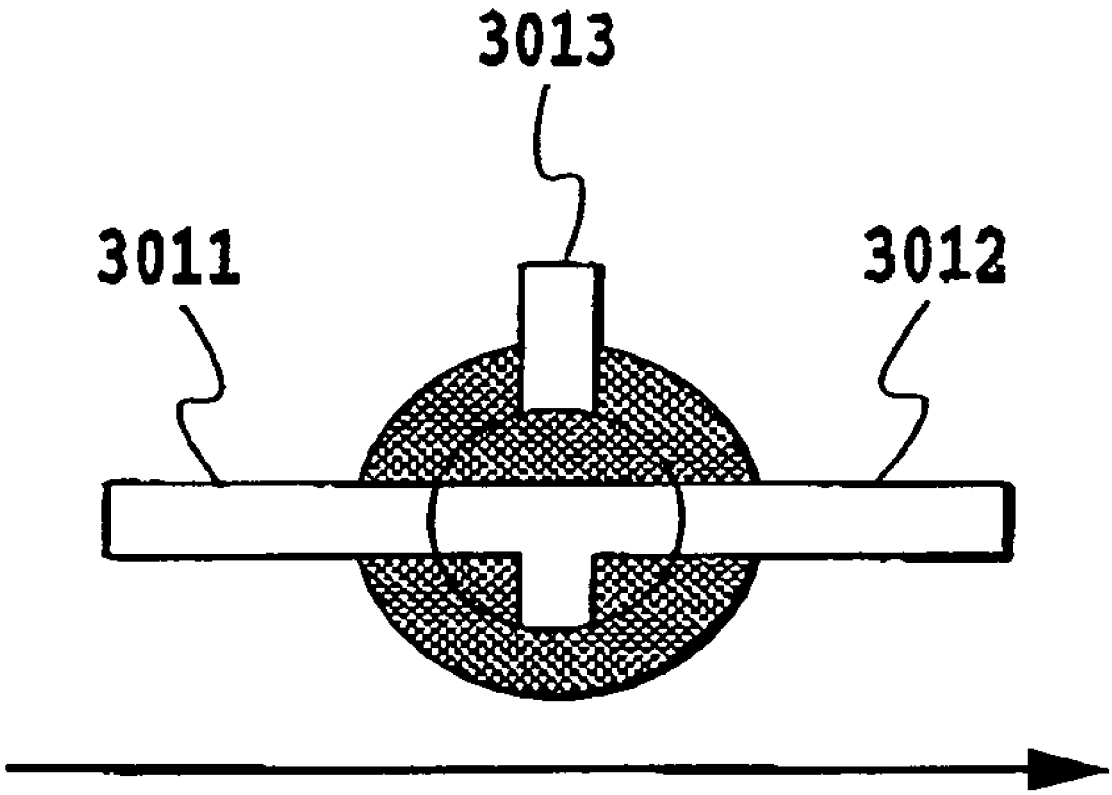
FIG. 19 is a diagram illustrating a three-way valve according to the embodiment of the present invention.
Figure 20:
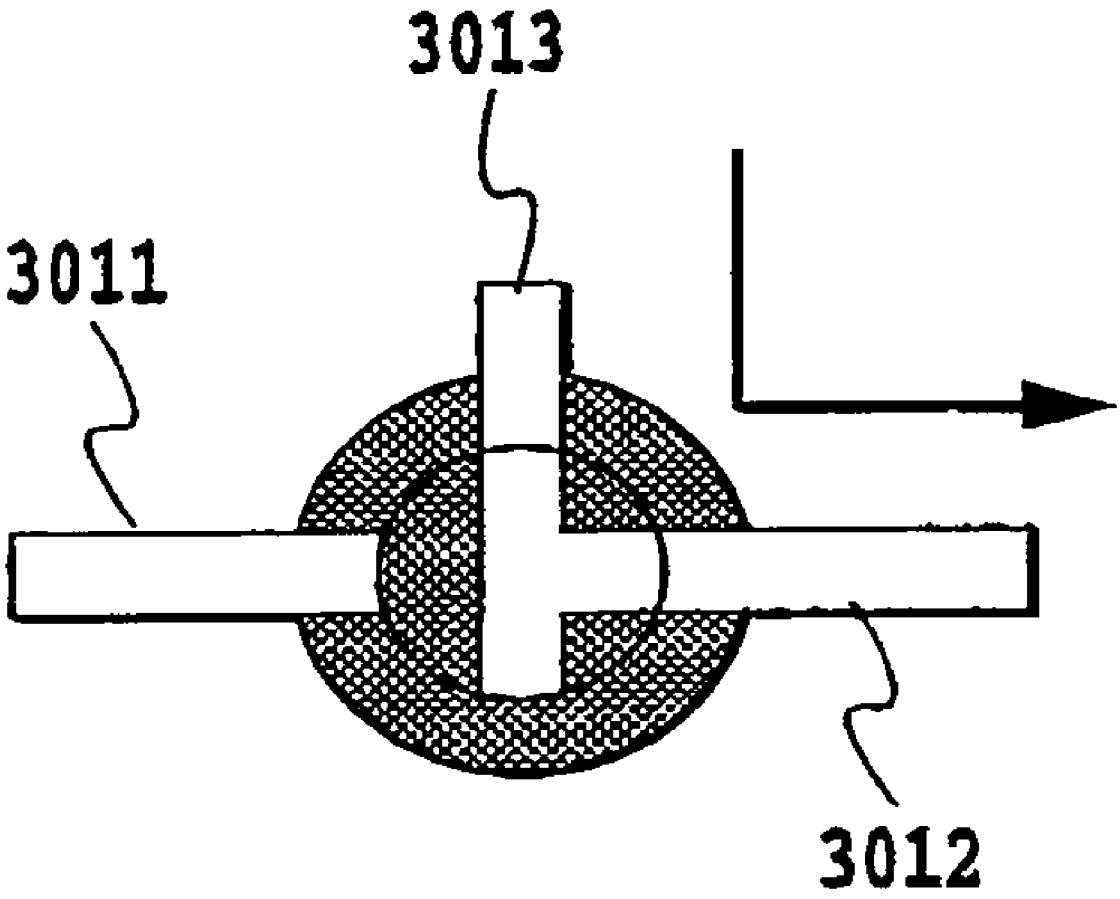
FIG. 20 is a diagram illustrating the three-way valve according to the embodiment of the present invention.

According to this embodiment, various types of the selector valves 3006 are applicable provided that they selectively enable and disable the communication between the first channel 3001 and the air. In this case, a three-way valve is used as shown in FIG. 11. The three-way valve 3006 has three ports that are in communication with one another. It is possible to allow two of the three ports to selectively communicate with any two of the storage tank tube 3011, liquid holding member tube 3012, and air communicating port 3013 in the first channel 3001. The three-way valve 3006 allows the selective switching between a connected state in which the tubes 3011 and 3012 are in communication as shown in FIG. 19 and a connected state in which the tube 3012 and the air communicating port 3013 are in communication as shown in FIG. 20. This enables the application liquid in the storage tank 3003 or air obtained through the air communicating port 3013 to be selectively supplied to the space S formed by the liquid holding member 2001 and the applying roller 1001. Specifically, while the tubes 3011 and 3012 are in communication as shown in FIG. 19, the application liquid in the storage tank 3003 is supplied to the liquid holding space S. On the other hand, while the tube 3012 and the air communicating port 3013 are in communication as shown in FIG. 20, the air obtained through the air communicating port 3013 is supplied to the liquid holding space S. The switching of the three-way valve 3006 is carried out in accordance with a control signal from a control section 4000 described later. Thus, the application liquid is filled or supplied.

(Control System)

Figure 12:
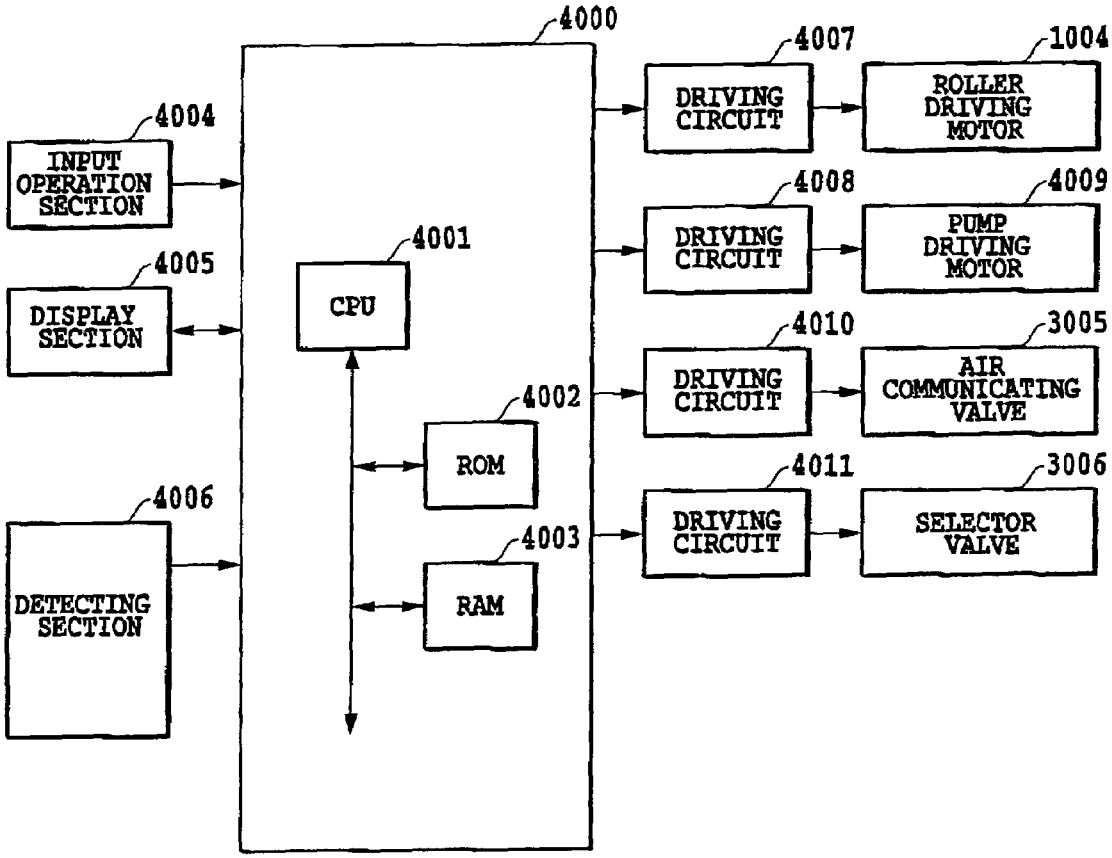
FIG. 12 is a block diagram generally showing the configuration of a control system according to the embodiment of the present invention.

FIG. 12 is a block diagram generally showing the configuration of the control system in the liquid applying apparatus according to the present embodiment.

In FIG. 12, the control section 4000 operates as control means for controlling the whole liquid applying apparatus. The control section 4000 has a CPU 4001 that performs various process operations such as calculations, control, and determinations, a ROM 4002 that stores, for example, control programs for processes executed by the CPU 4001, such as the one described later in FIG. 13, and a RAM 4003 that temporarily stores data used during process operations of the CPU 4001 as well as input data.

The control section 4000 connects to an input operation section 4004 including a keyboard, various switches, or the like with which predetermined instructions or data are input, a display section 4005 that provides various displays including inputs to and the set state of the liquid applying apparatus, and a detecting section 4006 including a sensor or the like which detects the position of a applying medium or the operational state of each section. The control section 4000 also connects to the roller driving motor 1004, a pump driving motor 4009, an air communicating valve 3005, and the selector valve 3006, via driving circuits 4007, 4008, 4010, and 4011.

(Liquid Applying Operation Sequence)

Figure 13:
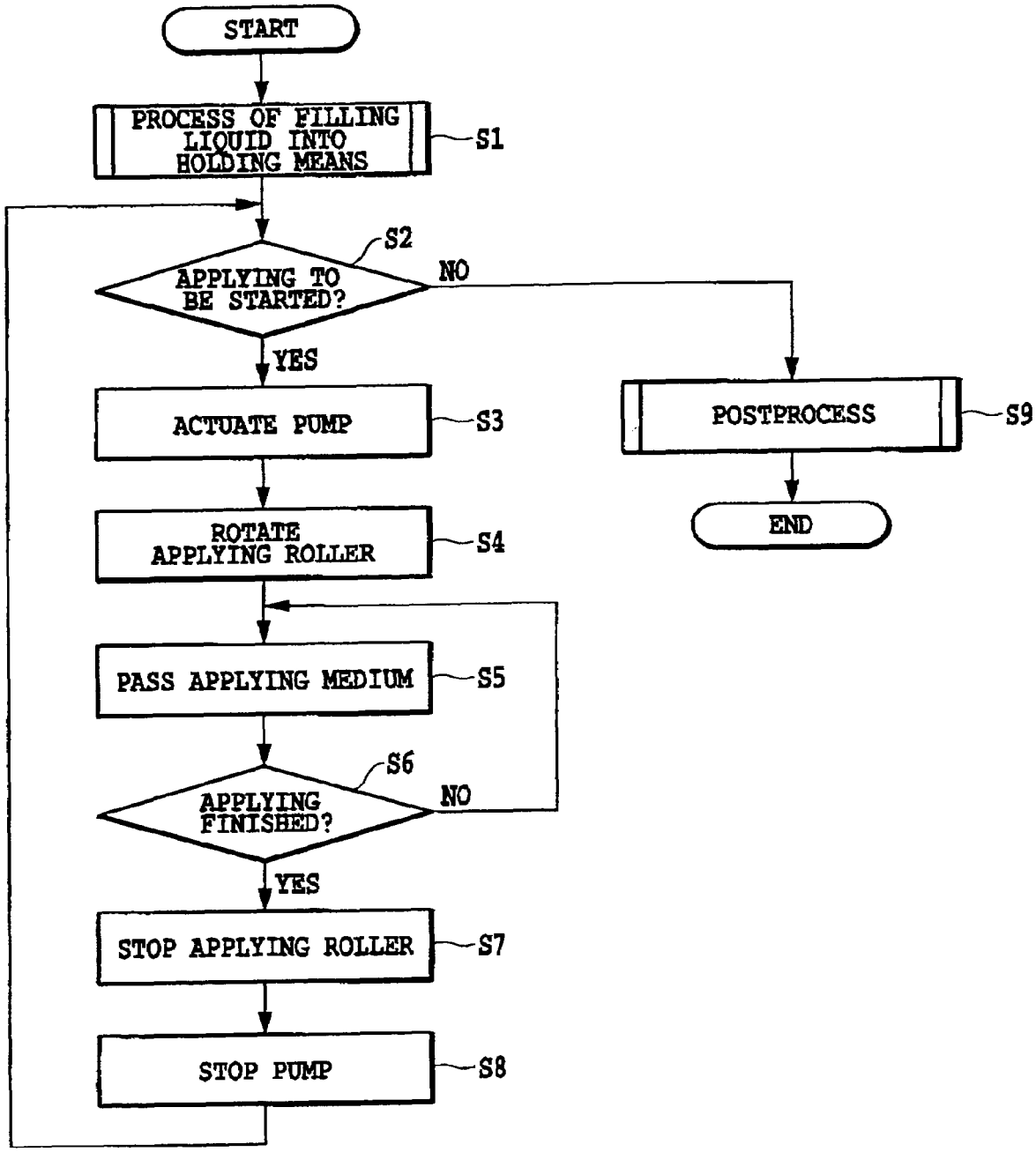
FIG. 13 is a flowchart showing a liquid applying operation sequence according to the embodiment of the present invention.

FIG. 13 is a flowchart showing a process procedure for applying a liquid in the liquid applying apparatus according to the present embodiment. The steps of liquid application will be described below with reference to this flowchart.

When the liquid applying apparatus is powered on, the control section 4000 executes an applying operation sequence described below, in accordance with the flowchart shown in FIG. 13.

Filling Step

In step S1, the liquid holding space S is filled with the application liquid. In this filling step, the air communicating valve 3005 of the storage tank 3003 is first opened to the air. The selector valve (three-way valve) 3006 is also switched as shown in FIG. 19. This allows the tubes 3011 and 3012 to communicate with each other to drive the pump 3007 for a specified time. Thus, air and/or the application liquid flows from the pump 3007 to the storage tank 3003. Accordingly, if the liquid holding space S and the channels 3001 and 3002 have not been filled with the application liquid, the pump drives the air inside the space and channels out to the storage tank 3003. The air is then discharged to the exterior of the apparatus. These portions are then filled with the application liquid. On the other hand, if these portions have already been filled with the application liquid, the application liquid in these portions starts to flow. These portions are thus supplied with an application liquid having an appropriate concentration and viscosity. This initial operation allows the application liquid to be supplied to the applying roller 1001. It is thus possible to apply the application liquid to the applying medium.

Applying Step

Then, an applying start instruction is input (step S2). Then, the pump 3007 restarts operation (step S3). The applying roller starts rotating clockwise as shown by an arrow in FIG. 1 (step S4). The rotation of the applying roller 1001 causes the application liquid L filled into the liquid holding space S to slipperily flow between the applying roller 1001 and a lower edge 2011 of the abutting member 2009 against the pushing force of the abutting member 2009 of the liquid holding member 2001, which force acts on the applying roller 1001. The application liquid adheres to the outer periphery of the applying roller 1001 in layer form. The application liquid L adhering to the applying roller 1001 is transferred to the abutting portion between the applying roller 1001 and the counter roller 1002.

Figure 9:
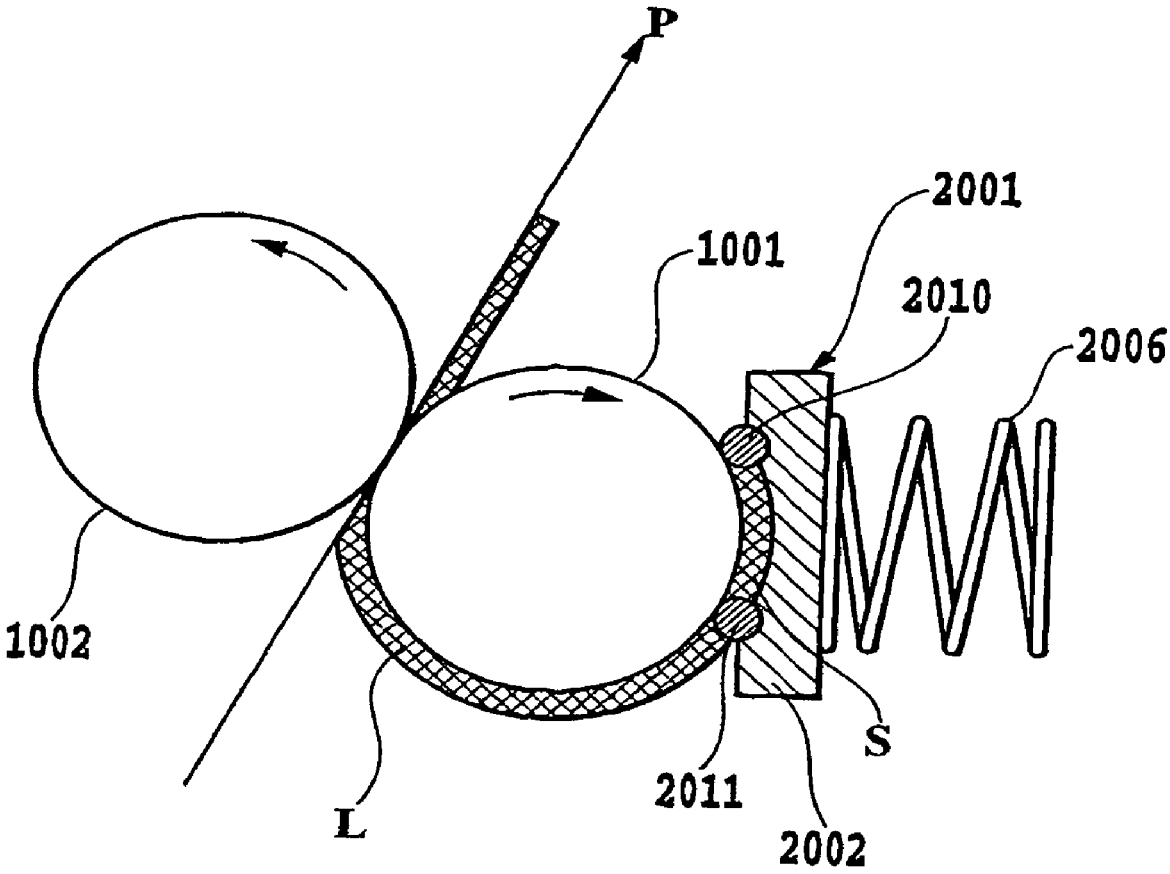
FIG. 9 is a vertical sectional view showing how a application liquid is filled into a liquid holding space formed by the liquid holding member and the applying roller and how a liquid is applied to an applying medium by the rotation of the applying roller.

Then, an applying medium supplying mechanism 1006 conveys an applying medium between the applying roller 1001 and the counter roller 1002. The applying medium is inserted between these rollers and conveyed to a sheet discharging section as the applying roller 1001 and the counter roller 1002 rotate (step S5). During this conveyance, the application liquid applied to the peripheral surface of the applying roller is transferred from the applying roller 1001 to the applying medium P as shown in FIG. 9. Of course, means for supplying an applying medium between the applying roller 1001 and the counter roller 1002 is not limited to the above supplying mechanism. It is possible to use any means, for example, manual means which uses a predetermined guide member or which is solely used.

In FIG. 9, an area with crossing oblique lines denotes the application liquid L. In this case, the application liquid on the applying roller 1001 and applying medium P is shown considerably thicker than the actual one in order to clearly illustrate how the application liquid L is applied.

As described above, an applied part of the applying medium P is conveyed in the direction of the arrow under the conveying force of the applying roller 1001. Further, an unapplied part of the applying medium P is conveyed to the contact portion between the applying medium P and the applying roller 1001. This operation is continuously or intermittently performed to apply the application liquid to the entire applying medium.

FIG. 9 shows the ideal applied state in which the all of the application liquid L adhering to the applying roller 1001 after slipperily flowing out of the abutting member 2009 is transferred to the applying medium P. However, actually, not all of the application liquid L adhering to the applying roller 1001 is transferred to the applying medium P. Specifically, when the conveyed applying medium P separates from the applying roller 1001, the application liquid L often also adheres to and remains on the applying roller 1001. The amount of application liquid L remaining on the applying roller 1001 varies depending on the material of the applying medium P or the state of fine concaves and convexes on the surface of the applying medium P. However, if the applying medium P is ordinary paper, the application liquid L remains on the peripheral surface of the applying roller 1001 after an applying operation.

Figure 24:
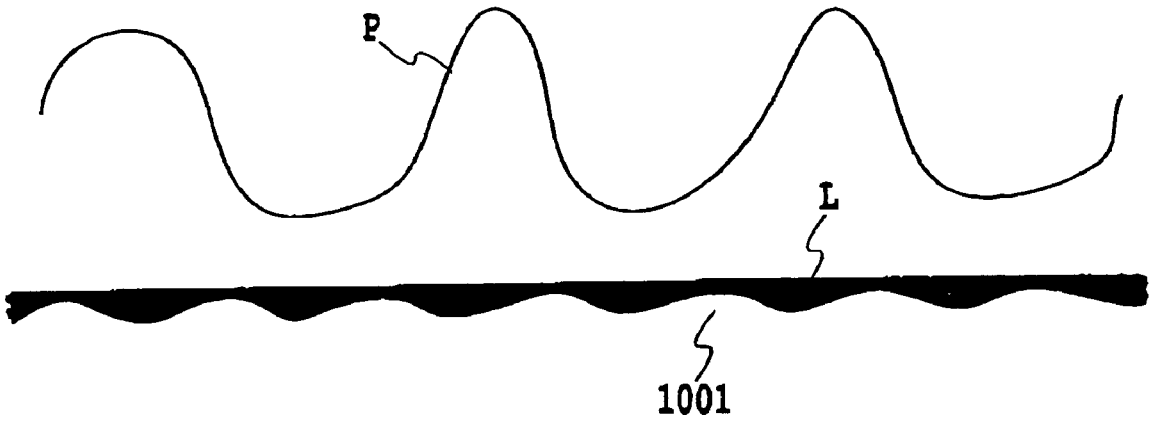
FIG. 24 is a diagram illustrating an applying process executed on a surface of a medium P and a applying surface if the medium is ordinary paper.
Figure 25:
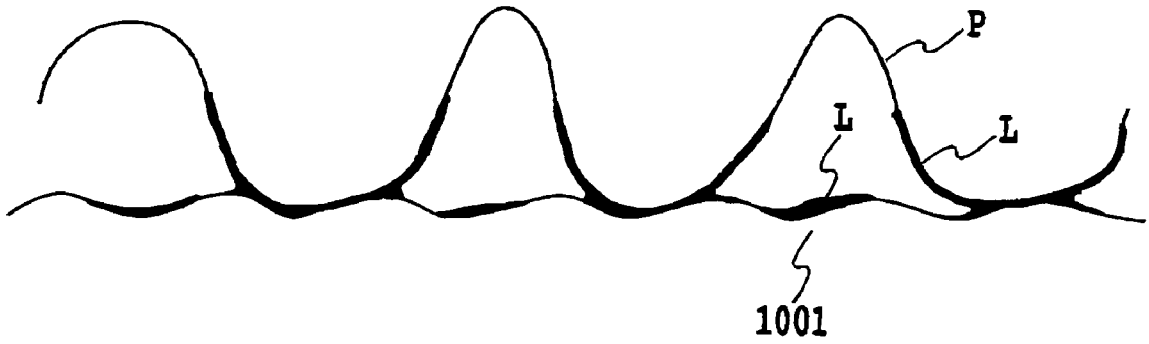
FIG. 25 is a diagram illustrating the applying process executed on the surface of the medium P and the applying surface if the medium is ordinary paper.
Figure 26:
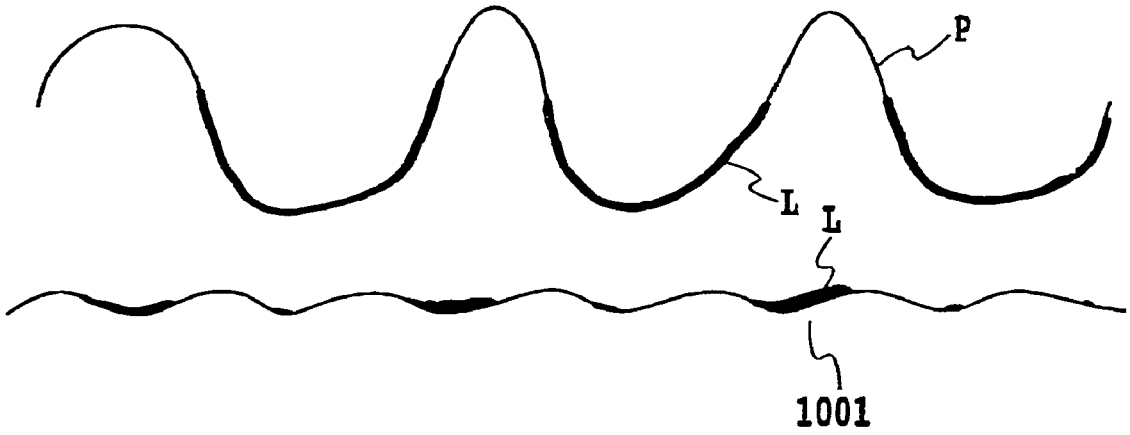
FIG. 26 is a diagram illustrating the applying process executed on the surface of the medium P and the applying surface if the medium is ordinary paper.

FIGS. 24, 25, and 26 are diagrams illustrating the process of applying between a surface of the medium P and an applying surface in the case where the medium is ordinary paper. In these figures, the liquid is painted over with black.

FIG. 24 shows the state of the upstream side of the nip portion between the applying roller 1001 and the counter roller 1002. In this figure, the liquid adheres to the applying surface of the applying roller 1001 so as to slightly cover the fine concaves and convexes on the applying surface.

FIG. 25 shows the state of the surface of ordinary paper, the medium P, and the applying surface of the applying roller 1001, at the nip portion between the applying roller 1001 and the counter roller 1002. In this figure, the convexes on the surface of the ordinary paper, the medium P, contact the applying surface of the applying roller 1001. The liquid instantaneously permeates through or sticks to fibers in the surface of the ordinary paper, the medium P, through the contacting parts. The liquid adhering to those parts of the applying surface of the applying roller which do not contact the convex portions on the surface of the ordinary paper remains on the applying surface.

FIG. 26 shows the state of the downstream side of the nip portion between the applying roller 1001 and the counter roller 1002. In this figure, the medium has completely left the applying surface of the applying roller 1001. The liquid adhering to those parts of the applying surface of the applying roller 1001 which do not contact with the convex portions on the surface of the ordinary paper remains on the applying surface. The liquid on the contacting parts also remains with very small amount on the coating surface.

The application liquid remaining on the applying roller 1001 slipperily flows between the applying roller 1001 and the upper edge 2010 of the abutting member 2009 and returns to the liquid holding space S, against the pushing force of the abutting member 2009 of the liquid holding member 2001, which force acts on the applying roller 1001. The application liquid is then mixed with the application liquid filled into the space S.

Figure 10:
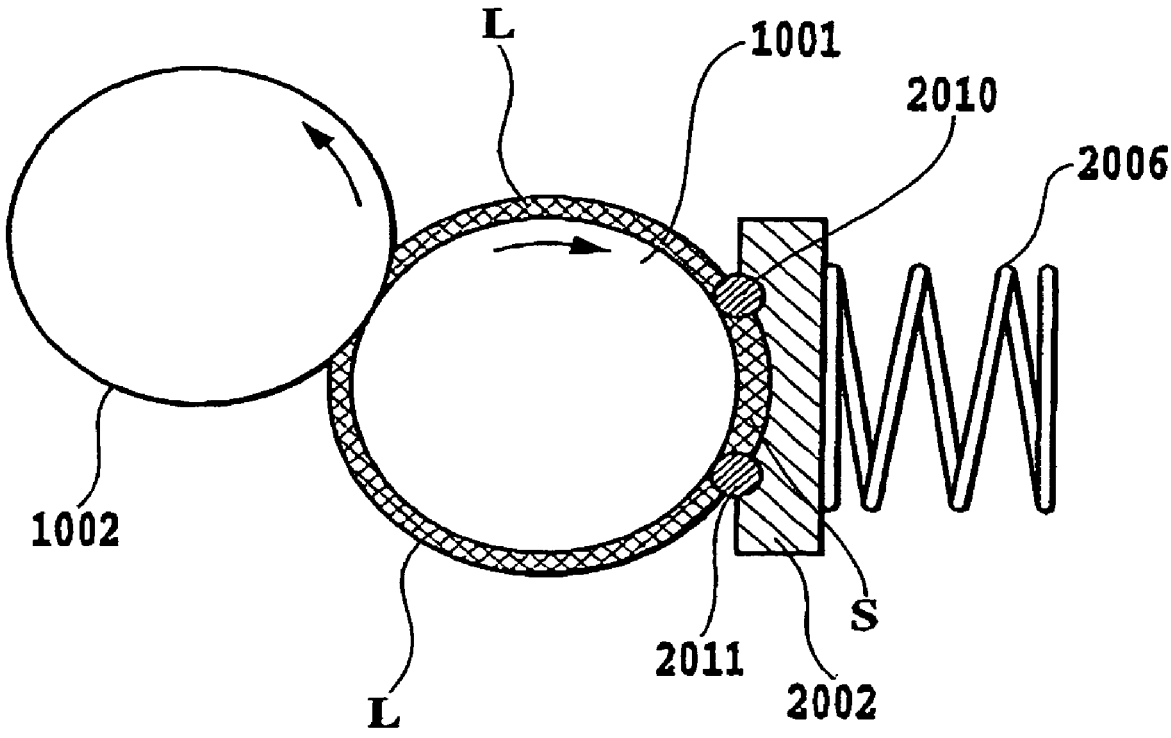
FIG. 10 is a vertical sectional view showing how the application liquid is filled into the liquid holding space formed by the liquid holding member and the applying roller and how the applying roller is rotated when no applying medium is present.

The operation of returning the application liquid is similarly performed if the applying roller 1001 is rotated while no applying medium is present as shown in FIG. 10. That is, the application liquid adhering to the outer periphery of the applying roller 1001 as a result of the rotation of the applying roller 1001 slipperily flows through the abutting portion between the applying roller 1001 and the counter roller 1002. After flowing through the abutting portion, the application liquid is separated into two parts directed to the applying roller 1001 and the counter roller 1002, respectively. The application liquid remains on the applying roller 1001. Then, the application liquid adhering to the applying roller 1001 slipperily flows between the upper edge 2010 of the abutting member 2009 and the applying roller 1001 to enter the liquid holding space S. The application liquid is then mixed with the application liquid filled into the space S.

During the applying step, the pump 3007 is driven to circulate the application liquid between the storage tank 3003 and the liquid holding member 2001. Thus circulation of the application liquid solves the following problem: when an area of the applying roller 1001 which has finished applying the liquid to the applying medium returns to the liquid holding space S, the application liquid remaining on the applying roller 1001 without being applied is disadvantageously mixed into the application liquid in the liquid holding space S, together with bubbles. This also solves the following problem: evaporation that may occur even in the liquid-tight liquid holding space S disadvantageously increases the concentration of the application liquid.

Ending Step

Once the operation of applying the liquid to the applying medium has been performed as described above, the apparatus determines whether or not to finish the applying step. If the applying step is not to be finished, the process returns to step S5 to repeat the applying operation until the applying step is executed on the all the parts of the applying medium to which the liquid needs to be applied. When the applying step is finished, the applying roller 1001 is stopped (step S7). Moreover, the driving of the pump 3007 is stopped (step S8). Subsequently, the process shifts to step S2 to repeat the operations from step S2 to step S8 unless an applying start instruction is input before a predetermined period elapses. Even after the predetermined period has elapsed, if the applying start instruction is not input, a post process is executed such as a collecting operation of collecting the application liquid from the liquid holding space S and liquid channels (step S9). Then, the coating process is finished.

In step S8, the pump 3007 may not be stopped. In this case, after stopping the applying roller 1001 in step S7, the process proceeds to step S2.

In the present embodiment, the process of collecting the application liquid held by the liquid holding member 2001 is executed in step S9. The collecting process executed in step S9 will be described below in detail with reference to FIG. 21.

Figure 21:
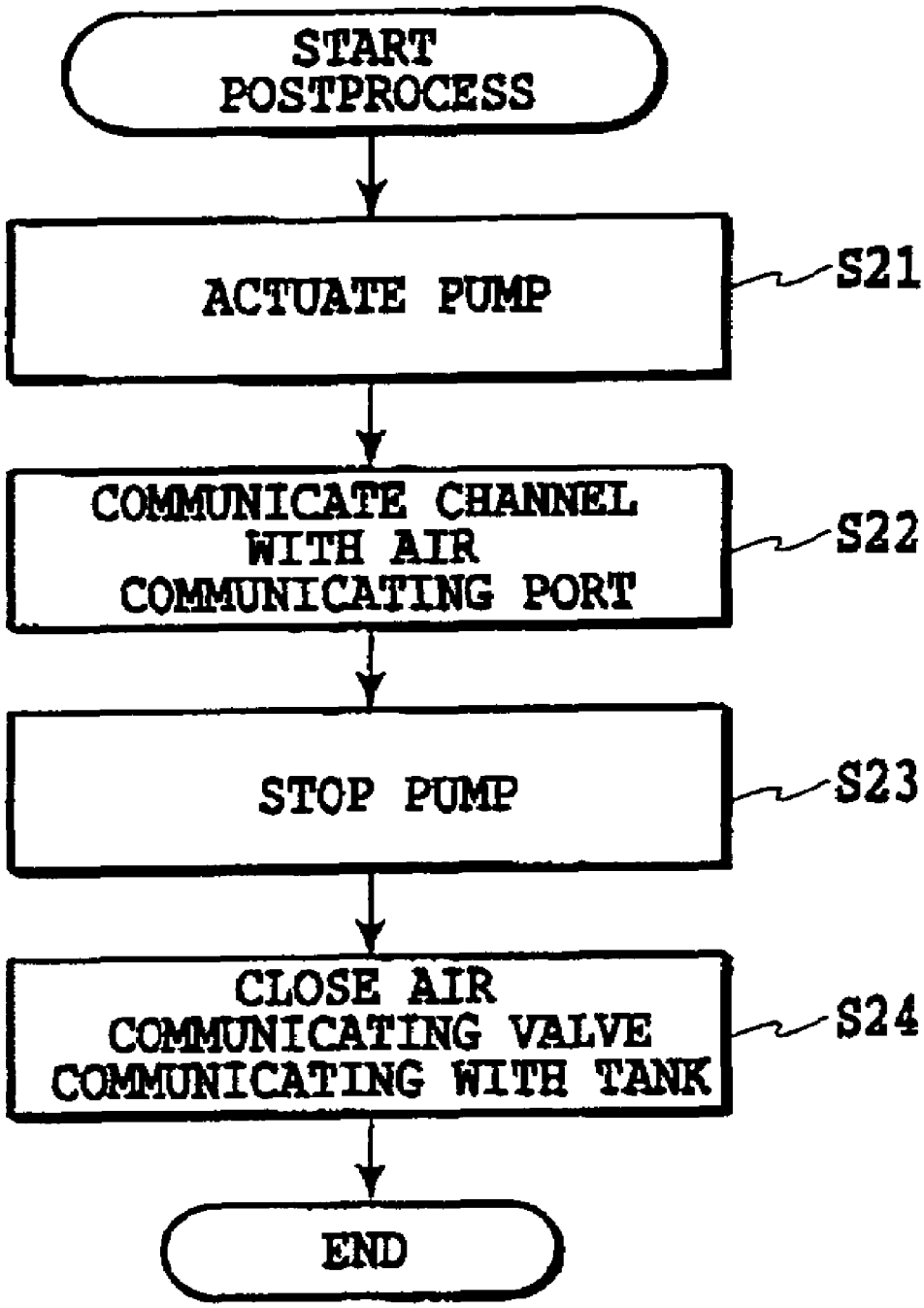
FIG. 21 is a flowchart showing the procedure of a postprocess in the flowchart shown in FIG. 13.

FIG. 21 is a flowchart showing a process procedure for collecting a liquid in the liquid applying apparatus according to the present embodiment.

In step S2 in FIG. 13, when the apparatus determines that the applying start instruction has not been input, the apparatus starts an operation of collecting the application liquid held in the liquid holding member 2001.

Once the application liquid collecting operation is started, the pump 3007 is driven in step S21 in FIG. 21 to generate a flow from the pump 3007 to the storage tank 3003. Provided that the pump 3007 is not stopped in step S8, the present step is not executed. Instead, when the application liquid collecting operation is started, the process proceeds to step S22.

In step S22, the selector valve (three-way valve) 3006 is switched as shown in FIG. 20. The air communicating port 3013 is thus allowed to communicate with the tube 3012. That is, the supply path from the storage tank 3003 to the liquid holding member 2001 is shut off to inhibit the supply of the application liquid to the liquid holding member 2001. At this time, the pump 3007 is creating a flow in the direction of an arrow in FIG. 11, so that the application liquid present in the channel from the liquid holding tube 3012 to the second channel 3002, including the liquid holding member 2001, is collected in the storage tank 3003. Further, they are filled with air from the air communicating port 3013.

In step S23, the driving of the pump 3003 is stopped. Then, the storage tank tube 30022 is shut off from the liquid holding member tube 30021. Further, the tube 3011 is shut off from the tube 3012 by the selector valve 3006. The pump 3007 may be stopped after a predetermined time elapses after the switching of the selector valve 3006 in step S22. Further, the liquid holding member 2001 may contain means for sensing a timing for stopping the pump 3007, for example, a sensor serving as means for sensing whether or not any application liquid remains in the liquid holding member 2001. Then, the pump 3003 may be stopped on the basis of sensed information.

In step S24, the air communicating port 3004 is closed. In this state, the storage tank 3003 is shut off from the air.

Thus, when the applying operation is not performed, the application liquid is collected from the liquid holding member 2001 to prevent the application liquid from being left in the liquid holding member 2001 for a long time. It is thus possible to reduce evaporation that may occur when the application liquid is left for a long time. Further, when the collecting operation is finished, the storage tank 3003 and thus the channels are shut off from the air. This makes it possible to prevent the application liquid from flowing out of the storage tank 3003 to the liquid holding member 2001. Accordingly, even if the apparatus is, for example, tilted to change its posture during transportation or storage, the leakage of the liquid from the liquid holding member 2001 can be reduced.

In the present embodiment, the selector valve 3006 is placed upstream of the pump 3007. However, the pump 3007 may be placed on a supply path (in this case, the first channel 3001), whereas the selector valve 3006 may be placed on a collecting path (in this case, the second channel 3002). In this case, in step S22 shown in FIG. 21, the selector valve 3006 is switched to allow the air communicating port 3013 to communicate with the liquid holding member side of the second channel 3002. On the other hand, the storage tank side of the second channel 3002 is shut off from its liquid holding member side. Then, the pump 3007 is reversely driven, that is, the rotation of the rotor 30071 of the pump 3007 is reversed to create a flow in the direction opposite to that of an arrow in FIG. 11. This allows the application liquid in the liquid holding member 2001 and channels to be collected and collected in the storage tank 3003. Then, the pump is stopped (step S23). The air communicating port 3004 in the storage tank is closed (step S24). The reverse driving of the pump 3007 may be started before, after, or simultaneously with the switching of the selector valve 3006.

In the present embodiment, in FIG. 11, the pump 3007 may be placed on the first channel 3001 between the selector valve 3006 and the liquid holding member 2001. However, in this case, means for preventing the countercurrent of the application liquid, for example, a check valve (not shown), must be placed on the second channel. The check valve can prevent the application liquid collected in the storage tank 3003 from flowing to the liquid holding member 2001.

Moreover, the pump 3007 used in the present embodiment has a function for shutting off the channels while not being driven. However, if the pump 3007 does not have a shutoff function, the check valve may be placed on the channel on which the pump 3007 is placed. The check valve may be placed on the storage tank 3003 side or the liquid holding member 2001 side with respect to the pump. Preferably, the check valve is placed on the storage tank 3003 side.

As described above, according to the present embodiment, if the applying operation is not performed, the application liquid can be collected from the channels containing the liquid holding member to the storage tank by switching the selector valve having the air communicating port and driving the pump. The collecting makes it possible to reduce evaporation that may occur when the application liquid is left in the liquid holding member for a long time.

Moreover, when the collecting the application liquid is finished, the selector valve and the pump or on-off valve placed in the channel are used to shut off the application liquid channels. The air communicating port formed in the storage tank is also shut off from the air. Consequently, even if the application liquid flows out of the storage tank, it can be prevented from reaching the liquid holding member. Therefore, even if the apparatus is tilted during transportation or storage, no application liquid is present in the liquid holding member at that time. Naturally enough, no water head occurs, thus inhibiting the leakage of the liquid from the liquid holding member.

Further, even if the liquid holding member is separated from the applying roller or the pressure under which the liquid holding member is abutted against the applying roller is reduced when the collecting is finished, no application liquid is present in the liquid holding member at that time. This prevents the application liquid from dripping from the liquid holding member.

Second Embodiment

The present embodiment is the applying apparatus described in the first embodiment wherein an on-off valve is used in place of the selector valve (three-way valve) 3006 to collect the liquid from the liquid holding space if the applying operation is not performed, the liquid holding space being formed between the applying roller and the liquid holding member to hold the liquid.

In the present embodiment, for the configurations of the coating apparatus, liquid holding member, and liquid channel, parts similar to those in the first embodiment are denoted by the same reference numerals, and their description is omitted. A description will be provided only of parts that are characteristic of the present embodiment.

Figure 22:
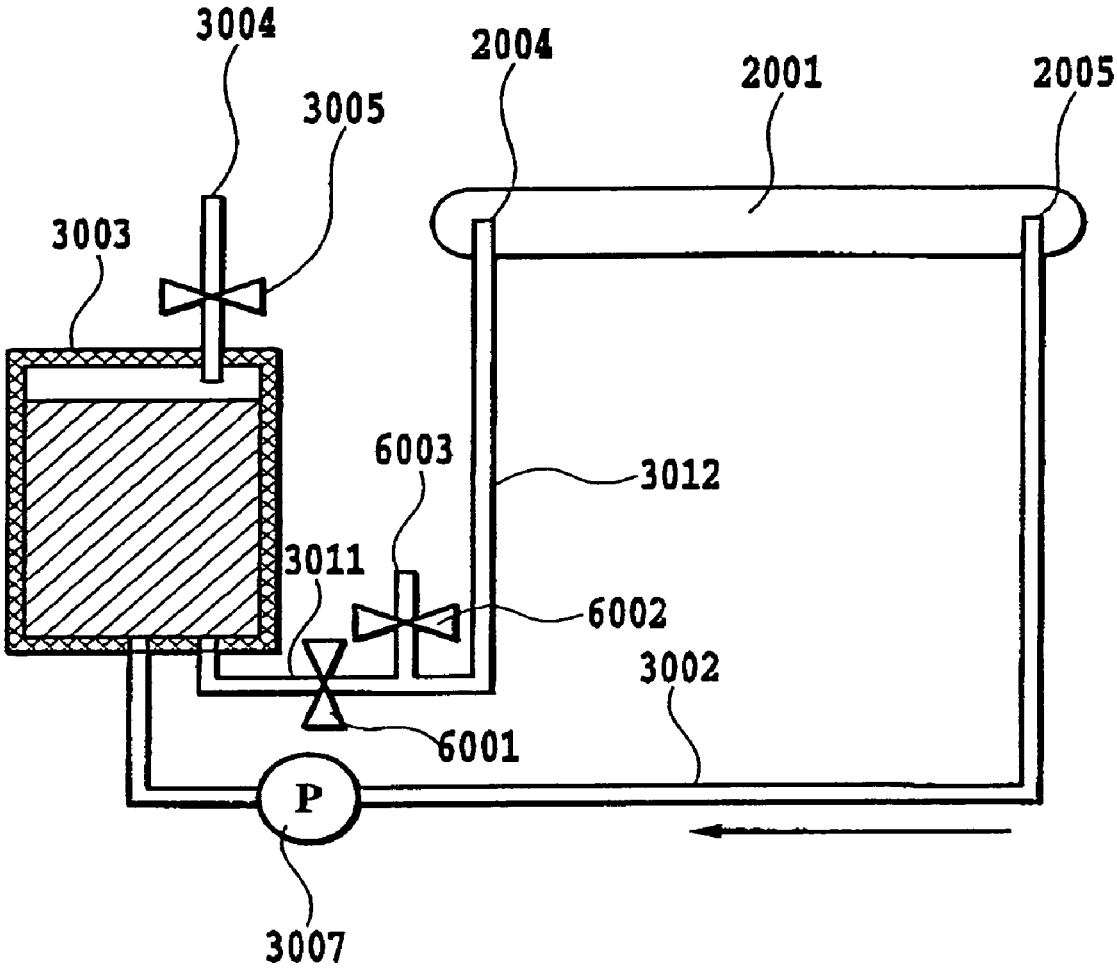
FIG. 22 is a diagram generally showing the configuration of a liquid channel in a liquid applying apparatus according to a second embodiment of the present invention.

FIG. 22 is a diagram generally illustrating the configuration of the liquid channel connected to the liquid holding member according to the present invention.

In FIG. 22, a first on-off valve 6001 and a second on-off valve 6002 are located in place of the selector valve (three-way valve) 3006 shown in FIG. 11. The first channel 3001 has an air communicating port 6003. As shown in FIG. 22, the second on-off valve 6002 is provided on the air communication port 6003. The first on-off valve 6001 is provided between the air communicating port 6003 and the storage tank 3003. The combination of open and closed states of the first and second on-off valves enables the selective switching between a connected state in which the tubes 3011 and 3012 are in communication and a connected state in which the air communicating port 6003 and the tube 3012 are in communication. This switching makes it possible to selectively supply the application liquid or air in the storage tank 3003 to the liquid holding space S formed by the liquid holding member 2001 and the applying roller 1001. Each of the first and second on-off valves 6001 and 6002 is opened and closed in accordance with a control signal from the control section 4000, shown in FIG. 12. The application liquid is thus filled or supplied.

(Liquid Applying Operation Sequence)

In the present embodiment, a process procedure for applying a liquid in the liquid applying apparatus is the same as that shown in FIG. 13 except for steps S1 and S9. Accordingly, the description of the other steps is omitted. A detailed description will be given of steps S1 and S9 according to the present embodiment.

In step S1, a step of filling the application liquid into the liquid holding space S is executed. In the filling step, the air communicating valve 3005 in the storage tank 3003 is opened to the air. The second on-off valve 6002 is closed, while the first on-off valve 6001 is opened, thus allowing the tubes 3011 and 3012 to communicate with each other. The pump 3007 is then driven for a specified time. This produces the same effect as that produced by the switching operation of the selector valve (three-way valve) 3006. The application liquid is thus filled into the liquid holding member 2001 and channels as descried in step S1 in FIG. 13.

In step S9, a process for collecting the application liquid held in the liquid holding member 2001 is executed in accordance with the process procedure shown in FIG. 21. In the present embodiment, a process procedure for collecting a liquid is the same as that shown in FIG. 21 except for step S22. Accordingly, the description of the other steps is omitted. A detailed description will be given of step S22 according to the present embodiment.

In step S22, the second on-off valve 6002 is opened at the same time when the first on-off valve 6001 is closed. This allows the air communicating port 6003 to communicate with the tube 3012. That is, the supply path from the storage tank 3003 to the liquid holding member 2001 is shut off by closing the first on-off valve 6001. At this time, the pump 3007 is creating a flow in the direction of an arrow shown in FIG. 22. Consequently, the application liquid in the channels containing the liquid holding member 2001 is collected in the storage tank 3003. In connection with the collecting operation, air from the air communicating port 6003 enters and fills the liquid holding member 2001 and the channels. For the first and second on-off valves 6001 and 6002, the first on-off valve 6001 may be closed before the second on-off valve 6002 is opened.

Then, steps S23 and S24 are executed to finish the operation of collecting the application liquid. Then, the storage tank 3003 is shut off from the air.

As described above, according to the present embodiment, the application liquid can be collected from the channels including the liquid holding member to the storage tank, as in the first embodiment. The collecting makes it possible to reduce evaporation that may occur when the application liquid is left in the liquid holding member for a long time.

Moreover, when the collecting of the application liquid is finished, the application liquid can be prevented from flowing out of the storage tank and reaching the liquid holding member. Therefore, even if the apparatus is tilted during transportation or storage, or the liquid holding member is separated from the applying roller or the pressure under which the liquid holding member is abutted against the applying roller is reduced when the collecting is finished, the liquid is prevented from leaking from the liquid holding member.

Third Embodiment

In the present embodiment, the water head in a part of the channel connecting the storage tank and the liquid holding member together is set higher than the highest level in the storage tank. The liquid is selectively supplied to and collected from the liquid holding member by selectively enabling and disabling the communication between the high water head and the air.

Figure 23:
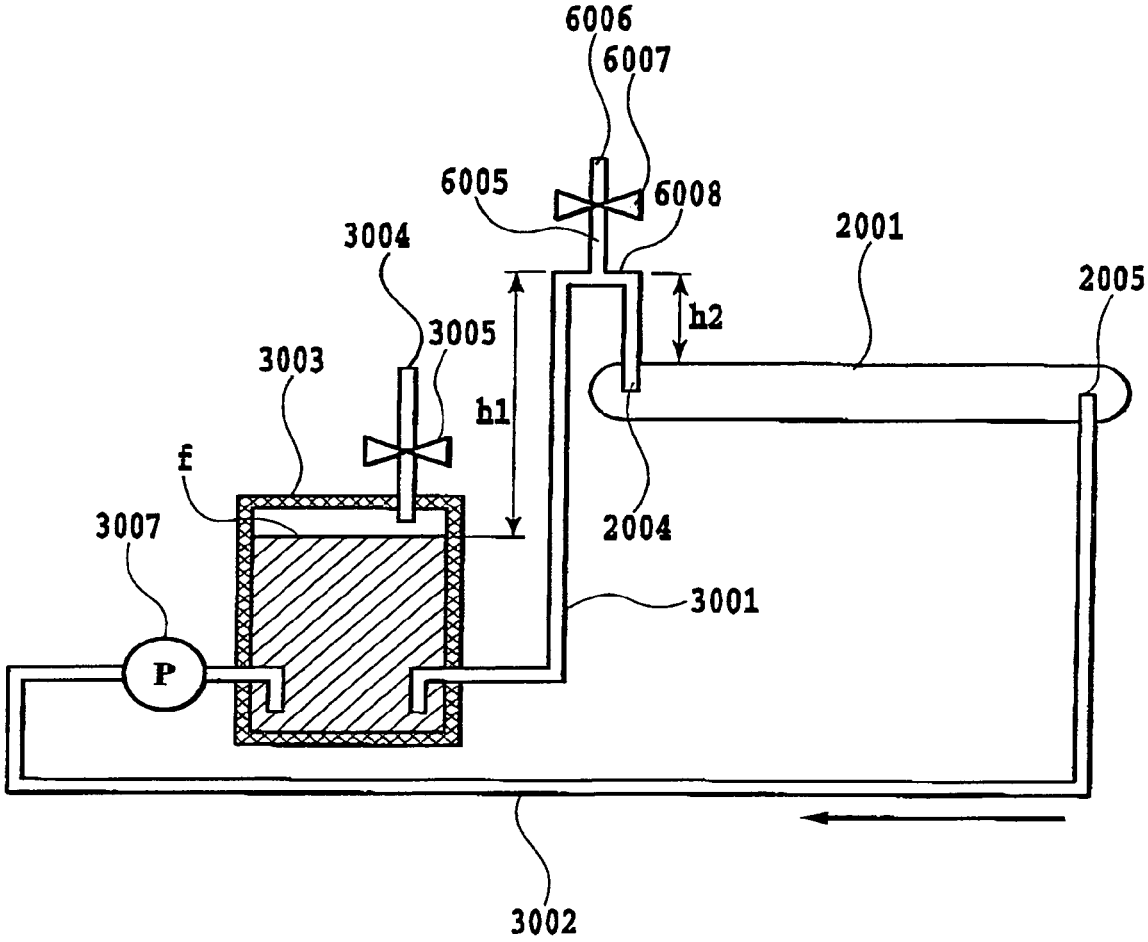
FIG. 23 is a diagram generally showing the configuration of a liquid channel in a liquid applying apparatus according to a third embodiment of the present invention.

FIG. 23 is a diagram generally showing the configuration of an application liquid channel according to the present embodiment. In the present embodiment, for the configurations of the coating apparatus, liquid holding member, and liquid channel, parts similar to those in the second embodiment are denoted by the same reference numerals.

As shown in FIG. 23, in the present embodiment, the liquid holding member (liquid holding means) 2001 and the storage tank (storage means) 3003 are also connected together via the first channel 3001 and second channel 3002. The pump 3007 is connected to the second channel 2002. Further, the first channel 3001 connects to an air introducing path 6005 at a connecting portion 6008, the path 6005 having an air communicating port 6006 at its upper end. The air introducing path 6005 is provided with an on-off valve 6007 that selectively enables and disables the communication between the air communicating port 6006 and the connecting portion 6008. In this case, the water head in the connecting portion 6008 is set higher (above in a gravitational direction) than the (highest) level (for example, f in the figure) in the storage tank 3003. In the figure, h1 denotes a difference in water head between the level f and the connecting portion. Therefore, in this present embodiment, the air communicating valve 3005 in the storage tank 3003 is opened, while the on-off valve 6007 in the air introducing path 6005 is closed. The pump 3007 is then driven. This operation enables the application liquid in the storage tank 3003 to flow in the direction of an arrow in the figure. The liquid can thus be supplied to the interior of the liquid holding member 2001. Further, when the application liquid is to be collected, the pump 3007 is driven, while the on-off valve 6007 is opened. This allows the following application liquid to be collected in the storage tank 3003 under the driving force of the pump 3007, the application liquid being present downstream of the connecting portion 6008, that is, the application liquid being present in the area extending from the connecting portion 6008 of the first channel 3001 to the liquid holding member 2001 and in the liquid holding member 2001 and second channel 3002. At the same time, these portions are filled with air flowing in through the air communicating port 3004. Further, the following application liquid is collected owing to gravity until the level of the liquid becomes the same as that in the storage tank 3003, the application liquid being present upstream of the connecting portion, that is, the application liquid being present in the area extending from the connecting portion 6008 of the first channel 3001 to the storage tank 3003.

Once the collecting of the application liquid is finished, the on-off valve 6007 is closed, while the air communicating valve 3005 is closed. This causes the storage tank 3003, the first channel 3001, the second channel 3002, and the liquid holding member 2001 to be shut off from the air.

Further, the water head in the connecting portion 6008 is higher than the (highest) level in the storage tank 3003. Accordingly, while the connecting portion 6008 is in communication with the air communicating port 6006, the application liquid present upstream of the connecting portion 6008 does not flow downstream beyond the connecting portion 6008.

More preferably, the connecting portion 6008 is placed so that its water head is higher than that of the liquid holding member 2001 as shown by h2 in the figure. This is because when the connecting portion 6008 communicates with the air, the application liquid present downstream of the connecting portion 608 can be prevented from flowing backward toward the connecting portion 6008 and the air communicating port 6006.

Thus, in the present embodiment, the application liquid can also be collected from the channels including the liquid holding member to the storage tank as in the case of the first and second embodiments. This makes it possible to reduce evaporation that may occur when the application liquid is left in the liquid holding member for a long time.

Another Embodiment

Figure 14:
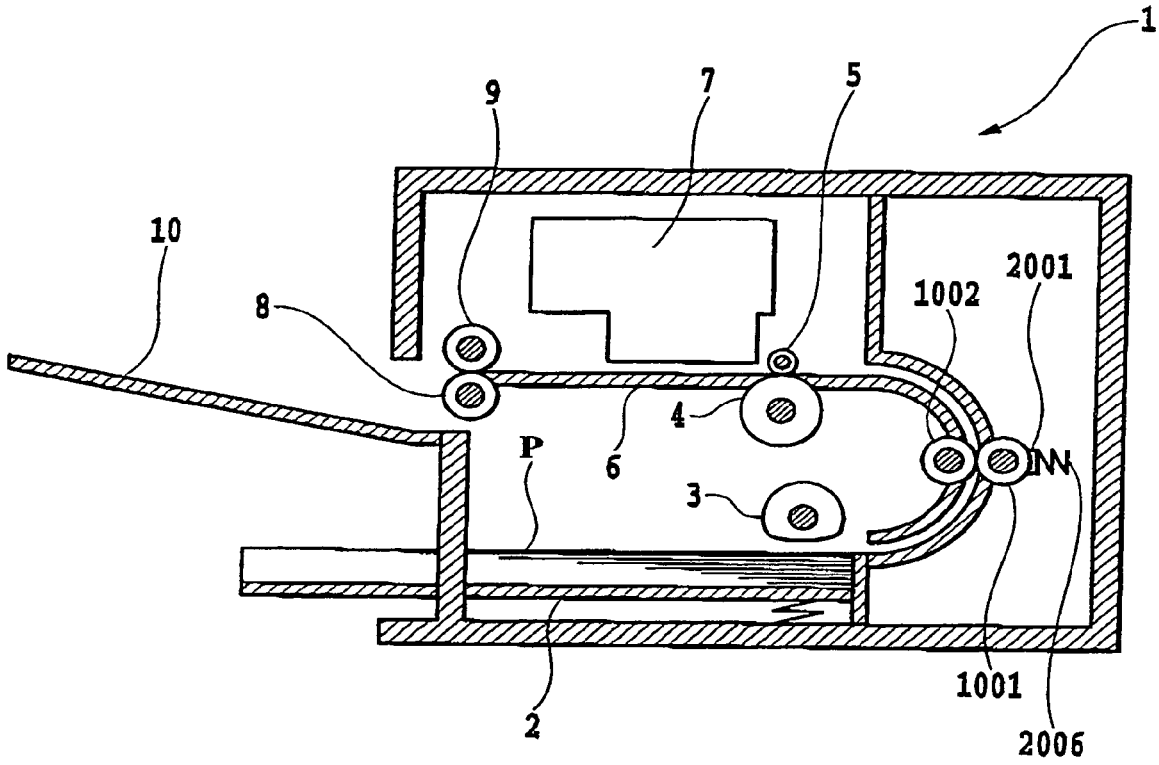
FIG. 14 is a vertical side view generally showing the configuration of an ink jet printing apparatus according to the embodiment of the present invention.

FIG. 14 is a diagram generally showing the configuration of an ink jet printing apparatus 1 comprising an applying mechanism having almost the same configuration as that of the above liquid applying apparatus.

The ink jet printing apparatus 1 is provided with a feeding tray 2 on which a plurality of print media P are stacked. A semicircular separating roller 3 separates each print medium P from the others stacked on the feeding tray and then feeds it to a conveying path. The applying roller 1001 and the counter roller 1002 are arranged in the conveying path; the applying roller 1001 and the counter roller 1002 constitute liquid applying means of the liquid applying mechanism. The print medium P fed by the feeding tray 2 is then fed to between the rollers 1001 and 1002. The applying roller 1001 is rotated clockwise in FIG. 14 by the rotation of a roller driving motor. The applying roller 1001 applies the application liquid to a print surface of the print medium P while conveying the print medium P. The print medium P to which the application liquid has been applied is fed to between a conveying roller 4 and a pinch roller 5. Then, the conveying roller 4 is rotated counterclockwise in the figure to convey the print medium P on a platen 6. The print medium P then moves to a position opposite to a print head 7 constituting printing means. The print head 7 is of an ink jet type in which a predetermined number of nozzles for ink ejection are disposed. While the print head 7 is being scanned in a direction perpendicular to the sheet of the drawing, printing is carried out by ejecting ink droplets from the nozzles to the print surface of the print medium P in accordance with print data. An image is formed on the print medium by alternately repeating a printing operation and a conveying operation performed by the conveying roller 4 to convey the print medium by a predetermined amount. Simultaneously with this image forming operation, the print medium P is sandwiched between a sheet discharging roller 8 and a sheet discharging spur 9 both provided downstream of the scan area of the print head in the conveying path for the print medium. The print medium P is then discharged onto a sheet discharging tray 10 by the rotation of the sheet discharging roller 8.

As this ink jet printing apparatus, what is called a full line type can be constructed in which an elongate print head having nozzles from which inks are ejected and which are disposed over the maximum width of the print medium is used to perform a printing operation.

The application liquid used in the present embodiment is a treatment liquid that facilitates the coagulation of pigments when inks composed of the pigments as color materials are used for printing.

In the present embodiment, the treatment liquid is used as an application liquid to react with the pigments, which are the color materials of the inks ejected to the print medium to which the treatment liquid has been applied. This facilitates the coagulation of the pigments. The facilitation of the coagulation of the pigments improves the printing density. Moreover, it is possible to suppress or prevent bleeding. The application liquid used in the ink jet printing apparatus is not limited to the above example.

Figure 15:
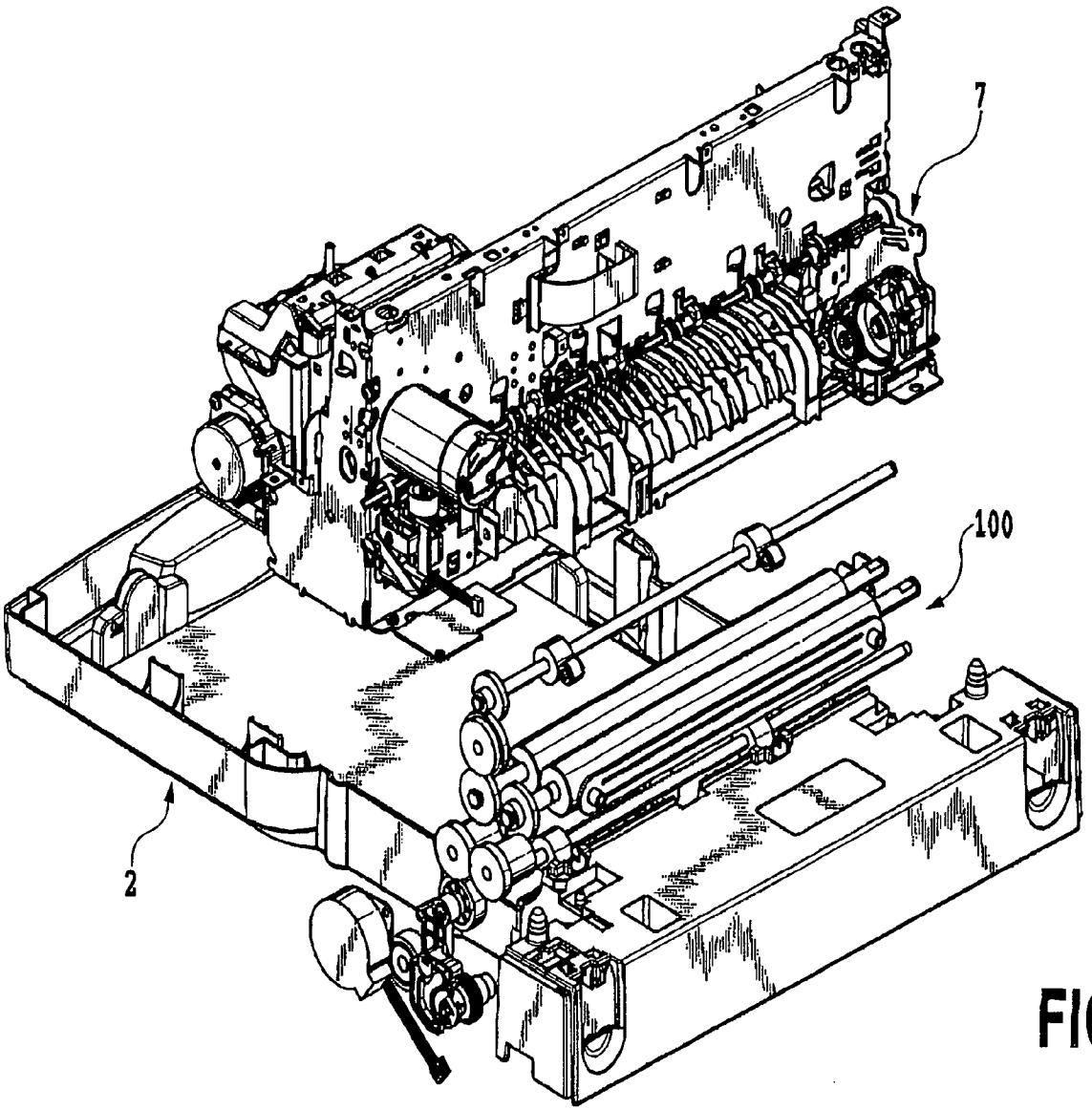
FIG. 15 is a perspective view showing how a printing section and the liquid applying apparatus are arranged if the ink jet printing apparatus according to the embodiment in FIG. 14 is configured as a serial printer type.

FIG. 15 is a perspective view showing an essential part of the above ink jet printing apparatus. As shown in the figure, an applying mechanism 100 is provided above one end of the feeding tray 2. A printing mechanism comprising the print head 7 and the like is provided above the applying mechanism 100 and above a central portion of the feeding tray 2.

Figure 16:
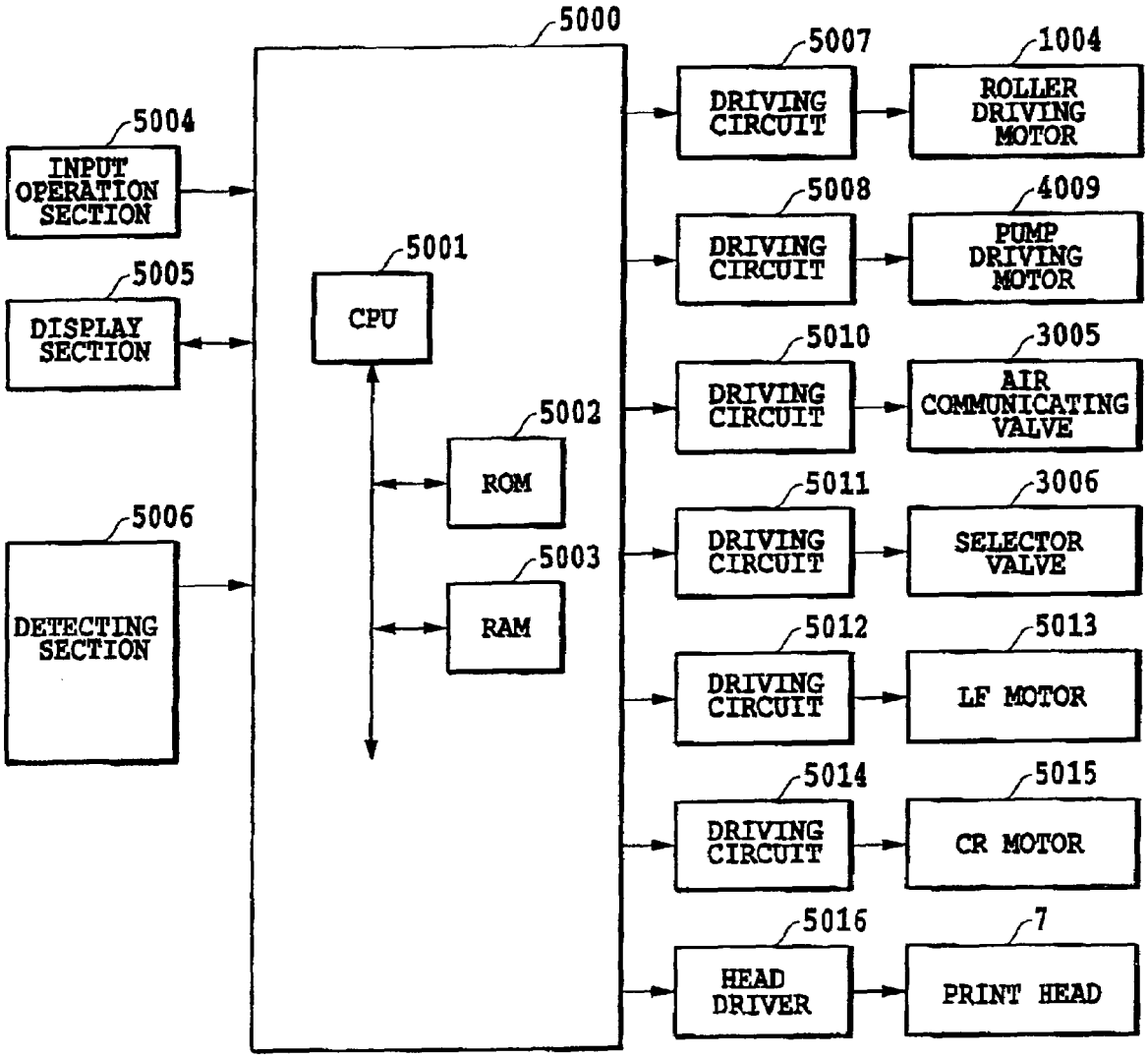
FIG. 16 is a block diagram generally showing the configuration of a control system of the ink jet printing apparatus according to the present invention.

FIG. 16 is a block diagram showing a control arrangement for the above ink jet printing apparatus. In this figure, the roller driving motor 1004, the pump driving motor 4009, and the actuator 3005 for the air communicating valve, all of which are elements of the liquid applying mechanism, are similar to those descried for the liquid applying apparatus.

In accordance with a program of a process procedure described later in FIG. 17, a CPU 5001 controls the driving of the elements of the applying mechanism. The CPU 5001 also controls the driving of an LF motor 5013, a CR motor 5015, and the print head 7 which relate to the printing mechanism, via driving circuits 5012 and 5014 and a head driver 5016. That is, driving by the LF motor 5013 rotates the conveying roller 4. Driving by the CR motor moves a carriage on which the print head 7 is mounted. Moreover, the CPU 5001 performs control such that inks are ejected through the nozzles in the print head.

Figure 17:
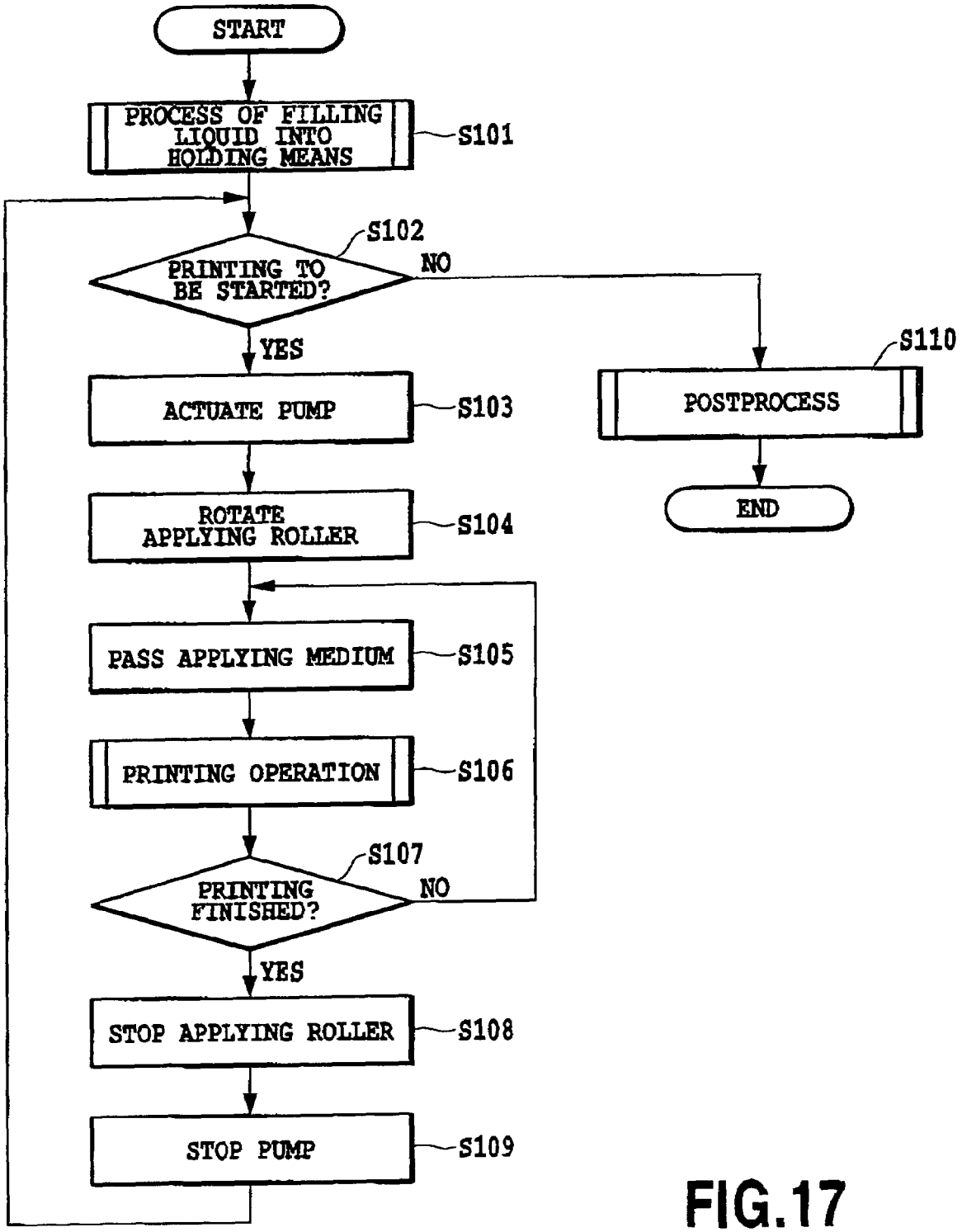
FIG. 17 is a flowchart showing the sequences of an applying operation and a printing operation according to another embodiment of the present invention.

FIG. 17 is a flowchart showing the procedure of liquid application and an accompanying printing operation in the ink jet printing apparatus according to the present embodiment. In the figure, the processing during steps S101, during S103 to S105, and during S108 to S110 is similar to that during step S1, during steps S3 to S5, and during steps S7 to S9, all the steps being shown in FIG. 13.

As shown in FIG. 17, in the present embodiment, a print start instruction is given (step S102). Then, a series of liquid applying operations such as pump activation are performed (steps S103 to S105). After this applying step, a printing operation is performed on a print medium having the application liquid applied to desired parts of the medium (step S106). That is, the print head 7 is scanned over the print medium P conveyed by the conveying roller 4 by a predetermined amount at a time. During the scan, inks are ejected from the nozzles in accordance with print data so as to adhere to the print medium to form dots. The adhering inks react with the application liquid, thus improving the concentration and preventing bleeding. The conveyance of the print medium and the scanning of the print head are repeated to print the print medium P. The finished print medium is discharged onto the sheet discharging tray 10.

In the present embodiment, as the liquid is applied to the print medium, printing is sequentially executed on parts of the print medium to which the liquid has already been applied. That is, the conveying path from the conveying roller to the print head is shorter than the print medium, and when a part of the print medium to which the liquid has already been applied reaches the scan area of the print head, the applying mechanism applies the liquid to another part of the print medium. Every time the print medium is conveyed by a predetermined amount, liquid application and printing are sequentially executed on different parts of the print medium. However, in an alternative form of application of the present invention, printing may be carried out after one print medium has been completely applied the application liquid to as described in Japanese Patent Application Laid-open No. 2002-096452.

When the apparatus determines in step S107 that the printing has been finished, the processing in step S108 and the subsequent steps is executed to finish the present process.

In the above embodiments, by way of example, the liquid is applied in the ink jet printing-based printing apparatus. However, the present invention is applicable to printing apparatuses based on other systems. For example, the degree of whiteness of the medium can be improved by using a liquid containing a fluorescent whitening agent as a application liquid. A liquid containing components to restrain a curl (phenomenon in which a medium becomes curve shape) of the application medium may be used. The printing means after the liquid application is not limited to the ink jet printing system. Effects can be produced using a printing system such as a thermal transfer system or an electrophotographic system. In a silver salt-based printing apparatus, a photosensitive agent as the application liquid may be applied before printing.

Yet Another Embodiment

In the above embodiments, when the liquid applying operation sequence shown in FIG. 13 or 17 is executed, the apparatus may determine in step S2 in FIG. 13 or in step S102 in FIG. 17 that the applying start instruction has not been input. Then, before the process proceeds to step S9 in FIG. 13 or step S110 in FIG. 17, the apparatus may determine whether or not a predetermined time has elapsed since the start of a standby mode of the liquid applying apparatus or ink jet printing apparatus.

If the apparatus determines that the predetermined time has elapsed since the start of the standby mode, it proceeds to step S9 in FIG. 13 or step S110 in FIG. 117 to execute the corresponding postprocess. If the apparatus determines that the predetermined time has not elapsed since the start of the standby mode, it proceeds to step S2 in FIG. 13 or step S102 in FIG. 117 to determine whether or not the applying start instruction has been input.

In step S9 or S100, a process procedure concerning the collecting of the application liquid shown in FIG. 21 is executed to collect the application liquid in the storage tank 3003.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

This application claims priority from Japanese Patent Application No. 2004-035805 filed Feb. 12, 2004, which is hereby incorporated by reference herein.

What is claimed is:

1. An ink jet printing apparatus comprising:

liquid applying means, which is provided with an applying member that applies a liquid to a medium and a holding member that abuts against the applying member to form a liquid holding space to hold the liquid, for applying the liquid held in the liquid holding space to the medium through the applying member by rotating the applying member;

a print head for ejecting ink on the medium to which the liquid has been applied by the liquid applying means;

storage means for storing the liquid;

a first path that allows the storage means and the holding member to communicate with each other;

a second path that allows the storage means and the holding member to communicate with each other; and switching means for switching whether the storage means and the holding member communicate with each other or the air and the holding member are communicated with each other for the first or second path; and liquid moving means for generating a flow of the liquid in a channel including the first path, the liquid holding space, and the second path; and wherein the switching means is switched to allow the air and the holding member to communicate with each other, and the liquid moving means causes the liquid to flow from the first path to the second path or from the second path to the first path to collect the liquid from the holding member to the storage means.

2. The apparatus according to claim 1, wherein the liquid moving means is placed downstream of the switching means when the holding means is filled with the liquid from the storage means, and is also placed in the first or second path.

3. The apparatus according to claim 2, wherein if the liquid moving means is placed in the first path, means for preventing the liquid from flowing backward is further placed in the second path.

4. The apparatus according to claim 1, wherein if the switching means is placed in the first path and the liquid moving means is placed in the second path, when the liquid is collected from the holding means to the storage means through the second path, the storage moving means moves the liquid from the first path to the second path.

5. The apparatus according to claim 1, wherein when a driving of the liquid moving means is stopped, the liquid moving means shuts off the channel in which the liquid moving means is placed.

6. The apparatus according to claim 1, wherein the storage means comprises air communicating means for selectively opening and closing an air communicating port that allows the storage means and the air to communicate with each other, and the air communicating means closes the air communicating port when the collecting of the liquid is finished.

7. The apparatus according to claim 1, wherein the liquid moving means moves the liquid from the first path to the second path to circulate the liquid between the storage means and the holding member.

8. The apparatus according to claim 1, wherein at least a part of the first path is placed so that a position of a water head in the first path is higher than a highest storage level that is a level observed when the largest amount of liquid is stored in the storage means, and the switching means allows at least a part of the first path placed at the water head position to communicate with the air.

9. An ink jet printing apparatus comprising:

liquid applying means, which is provided with an applying member that applies a liquid to a medium and a holding member that abuts against the applying member to form a liquid holding space to hold the liquid, for applying the liquid held in the liquid holding space to the medium through the applying member by rotating the applying member;

a print head for ejecting ink on the medium to which the liquid has been applied by the liquid applying means;

a storage means for storing the liquid;

a first path that allows the storage means and the holding member to communicate with each other;

a second path that allows the storage means and the holding member to communicate with each other;

switching means for switching whether the storage means and the holding member communicate with each other or the air and the holding member are communicated with each other for the first path; and liquid moving means for generating a flow of the liquid in a channel including the first path, the liquid holding space, and the second path, and wherein the switching means is placed in the first path, and the liquid moving means is placed downstream of the switching means in the first or second path.

10. An ink jet printing apparatus comprising:

a liquid applying means, which is provided with an applying member that applies a liquid to a medium and a holding member that abuts against the applying member to form a liquid holding space to hold the liquid, for applying the liquid held in the liquid holding space to the medium through the applying member by rotating the applying member;

a print head for ejecting ink on the medium to which the liquid has been applied by the liquid applying means;

storage means for storing the liquid;

a first and second paths that allow the storage means and the holding member to communicate with each other;

switching means for switching whether the storage means and the holding member are communicate with each other or the air and the holding member are communicated with each other for the first path;

liquid moving means for generating a flow of the liquid in a channel including the first path, the liquid holding space, and the second path, and collecting means for collecting the liquid from the channel to the storage means by using the switching means to allow the air and the holding member to communicate with each other and using the liquid moving means to generate a flow of the liquid, and wherein the switching means is placed upstream in a direction of a flow of the liquid which occurs when the collecting means collects the liquid, compared to the holding member, and the liquid moving means is placed downstream in the direction of the flow of the liquid which occurs when the collecting means collects the liquid, compared to the switching means.

11. An ink jet printing apparatus comprising:

a liquid applying means, which is provided with an applying member that applies a liquid to a medium and a holding member that abuts against the applying member to form a liquid holding space to hold the liquid, for applying the liquid held in the liquid holding space to the medium through the applying member by rotating the applying member;

a print head for ejecting ink on the medium to which the liquid has been applied by the liquid applying means;

storage means for storing the liquid;

a first path which allows the storage means and the holding means to communicate with each other and which is at least partly placed so that a water head in the first path is higher than a highest storage level that is a level observed when the largest amount of liquid is stored in the storage means;

a second path that allows the storage means and the holding member to communicate with each other;

switching means for switching whether a part of the first path which is at a position of the water head higher than the highest storage level is to communicate with the air or to be shut off from the air;

liquid moving means for generating a flow of the liquid in a channel including the first path, the liquid holding space, and the second path; and collecting means for collecting the liquid from the channel to the storage means by using the switching means to allow the air and the holding member to communicate with each other and using the liquid moving means to generate a flow of the liquid, and wherein the switching means is placed upstream in a direction of a flow of the liquid which occurs when the collecting means collects the liquid, compared to the holding member, and the liquid moving means is placed downstream in the direction of the flow of the liquid which occurs when the collecting means collects the liquid, compared to the switching means.

12. A method for controlling of an ink jet printing apparatus comprising liquid applying means, which is provided with an applying member that applies a liquid to a medium and a holding member that abuts against the applying member to form a liquid holding space to hold the liquid, for applying the liquid held in the liquid holding space to the medium through the applying member by rotating the applying member, and a print head for ejecting ink on the medium to which the liquid has been applied by the liquid applying means, comprising the steps of:

a step of allowing a first or second path to communicate with the air, the first or second path allowing a storage means for storing the liquid and the holding means to communicate with each other, and generating a flow of the liquid in a channel including the first path the liquid holding space and the second path, and collecting the liquid from the channel to the storage means by the flow of the liquid; and a step of, once the collecting step is finished, closing an air communicating port which is opened before the collecting process and which allows the storage means and the air to communicate with each other.

13. The method according to claim 12, wherein the collecting in the collecting step; is carried out by a liquid moving means for generating the flow of the liquid in the channel.

14. The method according to claim 13, wherein when the liquid moving means is stopped, the liquid moving means shuts off the channel in which the liquid moving means is placed.

15. The method according to claim 12, wherein during the applying of the liquid, the liquid is circulated between the storage means and the holding member.

* * * * *

UNITED STATES PATENT AND TRADEMARK OFFICE

CERTIFICATE OF CORRECTION

PATENT NO. : 7,270,409 B2
APPLICATION NO. : 11/052023
DATED : September 18, 2007
INVENTOR(S) : Iwasaki et al.

It is certified that error appears in the above-identified patent and that said Letters Patent is hereby corrected as shown below:

COLUMN 1:
Line 57, “liquid insolubilizes dyes.” should read --insolubilizes liquid dyes.--.

COLUMN 3:
Line 39, “communicate” should read --communicated--.
Line 47, “path. In” should read --path . ¶ In--.

COLUMN 4:
Line 13, “In” should read --¶ In--.
Line 51, “In” should read --¶ In--.

COLUMN 5:
Line 39, “member,” should read --member, and--.
Line 7, “a applying” should read --an applying--.
Line 8, “are” should read --is--.

COLUMN 6:
Line 25, “a appli-” should read --an appli- --.

COLUMN 7:
Line 5, “a applying” should read --an applying--.
Line 64, “convey a” should read --convey an--.

COLUMN 8:
Line 52, “applied” should read --applied to--.

COLUMN 10:
Line 3, “flowout” should read --flow out--.

COLUMN 11:
Line 36, “and” should be deleted.
Line 38, “a applying” should read --an applying--.

COLUMN 14:
Line 10, “on the” should read --on--.

COLUMN 15:
Line 65, “the application” should read --of the application--.

COLUMN 20:
Line 55, "to" should be deleted.
Line 66, "a appli-" should read --an appli- --.

COLUMN 23:
Line 12, "a" should be deleted
Line 15, "communicate" should read --communicated--.

COLUMN 24:
Line 33, "path" should read --path,--.
Line 42, "step;" should read --step--.

Signed and Sealed this

Sixteenth Day of February, 2010

David J. Kappos

David J. Kappos
*Director of the United States Patent and Trademark Office*